US008344643B2

(12) United States Patent
Fang et al.

(10) Patent No.: US 8,344,643 B2
(45) Date of Patent: Jan. 1, 2013

(54) DRIVER SYSTEM AND METHOD FOR MULTIPLE COLD-CATHODE FLUORESCENT LAMPS AND/OR EXTERNAL-ELECTRODE FLUORESCENT LAMPS

(75) Inventors: Lieyi Fang, Shanghai (CN); Changshan Zhang, Shanghai (CN); Zhiliang Chen, Shanghai (CN); Shifeng Zhao, Shanghai (CN)

(73) Assignee: On-Bright Electronic (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 12/764,747

(22) Filed: Apr. 21, 2010

(65) Prior Publication Data

US 2010/0244723 A1 Sep. 30, 2010

Related U.S. Application Data

(63) Continuation of application No. 11/872,604, filed on Oct. 15, 2007, now Pat. No. 7,750,581.

(30) Foreign Application Priority Data

Oct. 12, 2007 (CN) ..... 2007 1 0047024

(51) Int. Cl.
*H05B 37/00* (2006.01)

(52) U.S. Cl. ..... 315/277; 315/278; 315/291; 315/312

(58) Field of Classification Search ..... 315/209 R, 315/272–278, 291, 294, 307, 312
See application file for complete search history.

(56) References Cited

U.S. PATENT DOCUMENTS 4,810,904 A * 3/1989 Crawford ..... 327/33
6,121,734 A 9/2000 Szabados
6,559,606 B1 5/2003 Chou et al.
(Continued)

FOREIGN PATENT DOCUMENTS

CN 1741701 A 3/2006
(Continued)

OTHER PUBLICATIONS

Great Chip, ZAULas (Zip As UniLamp System), "New Inverter Technology for Big Size LCD Backlight," FPD International 2004 Seminar Speech, Apr. 7, 2004, downloaded from the Internet <<http://www.greatchip.com.tw/upload_data/b5-e.pdf>>, 30 pages.

(Continued)

*Primary Examiner* — Jimmy Vu
(74) *Attorney, Agent, or Firm* — Jones Day

(57) ABSTRACT

Driver system and method for multiple cold-cathode fluorescent lamps and/or external-electrode fluorescent lamps. According to an embodiment, the present invention provides a system for driving a plurality of cold-cathode fluorescent lamps. The system includes a subsystem configured to receive at least a DC voltage and generate a first AC voltage in response to at least the DC voltage. The system also includes a power converter configured to receive the first AC voltage and convert the first AC voltage to at least a second AC voltage. The system further includes a plurality of current balancing devices. Each of the plurality of current balancing devices is configured to receive two currents and balance the two currents. The plurality of current balancing devices includes at least a first current balancing device, a second current balancing device, and a third current balancing device. In addition, the system includes a plurality of lamp pairs.

26 Claims, 23 Drawing Sheets

U.S. PATENT DOCUMENTS

| | | | | |
|---|---|---|---|---|
| 6,717,372 | B2 | 4/2004 | Lin et al. | |
| 6,781,325 | B2 | 8/2004 | Lee et al. | |
| 7,061,183 | B1 | 6/2006 | Ball | |
| 7,075,248 | B2 | 7/2006 | Hsieh et al. | |
| 7,141,933 | B2 | 11/2006 | Ball | |
| 7,166,969 | B2 * | 1/2007 | Kohno | 315/209 PZ |
| 7,190,123 | B2 | 3/2007 | Lee | |
| 7,242,151 | B2 | 7/2007 | Chan et al. | |
| 7,309,964 | B2 * | 12/2007 | Wey et al. | 315/312 |
| 7,319,297 | B2 * | 1/2008 | Kuo | 315/282 |
| 7,402,957 | B2 * | 7/2008 | Shimura et al. | 315/276 |
| 7,425,949 | B2 | 9/2008 | Lin et al. | |
| 7,557,517 | B2 * | 7/2009 | Jin | 315/282 |
| 7,750,581 | B2 * | 7/2010 | Fang et al. | 315/277 |
| 7,880,407 | B2 | 2/2011 | Fang et al. | |
| 2005/0062436 | A1 * | 3/2005 | Jin | 315/244 |
| 2005/0093484 | A1 | 5/2005 | Ball | |
| 2005/0212790 | A1 | 9/2005 | Lin et al. | |
| 2005/0225261 | A1 | 10/2005 | Jin | |
| 2007/0007908 | A1 | 1/2007 | Kim et al. | |
| 2007/0085493 | A1 | 4/2007 | Kuo et al. | |
| 2007/0200507 | A1 * | 8/2007 | Meng et al. | 315/82 |

FOREIGN PATENT DOCUMENTS

| | | | |
|---|---|---|---|
| CN | 1893755 | A | 1/2007 |
| CN | 1953629 | A | 4/2007 |

OTHER PUBLICATIONS

Jin, Xiaoping, "Backlight Design for Large LCD TV Screens," Video/Imaging DesignLine, Jan. 2, 2006, downloaded from Internet <http://www.videsign/howto/showArticle.
jhtml?AricleId=175800309> on May 4, 2006, 8 pages.

United States Patent and Trademark Office, Office Action issued in related U.S. Appl. No. 12/958,275, mailed on Mar. 15, 2012.

Chinese Patent Office, Office Action dated Jul. 3, 2012, issued in counterpart Chinese Patent Application No. 200710047024.2, to which this instant U.S. application claims priority.

* cited by examiner

DRIVER SYSTEM AND METHOD FOR MULTIPLE COLD-CATHODE FLUORESCENT LAMPS AND/OR EXTERNAL-ELECTRODE FLUORESCENT LAMPS

CROSS-REFERENCES TO RELATED APPLICATIONS

This application is a continuation of U.S. patent application Ser. No. 11/872,604, filed Oct. 15, 2007, which claims priority to Chinese Patent Application No. 200710047024.2, filed Oct. 12, 2007, both of these applications being incorporated by reference herein for all purposes. U.S. patent application Ser. No. 11/872,604 is related to U.S. patent application Ser. No. 11/450,904, filed Jun. 8, 2006.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

The cold-cathode fluorescent lamp (CCFL) and external-electrode fluorescent lamp (EEFL) have been widely used to provide backlight for a liquid crystal display (LCD) module. The CCFL and EEFL often each require a high alternate current (AC) voltage such as 2 kV for ignition and normal operation. Such a high AC voltage can be provided by a CCFL driver system or an EEFL driver system. The CCFL driver system and the EEFL driver system each receive a low direct current (DC) voltage and convert the low DC voltage to the high AC voltage.

FIG. 1 is a simplified conventional driver system for CCFL and/or EEFL. The driver system 100 includes a control subsystem 110 and an AC power supply subsystem 120. The control subsystem 110 receives a power supply voltage $V_{DDA}$ and certain control signals. The control signals include an enabling (ENA) signal and a dimming (DIM) signal. In response, the control subsystem 110 outputs gate drive signals to the AC power supply subsystem 120. The AC power supply subsystem 120 includes one or more MOSFET transistors and one or more power transformers, and receives a low DC voltage $V_{IN}$. The MOSFET transistors convert the low DC voltage $V_{IN}$ to a low AC voltage in response to the gate drive signals. The low AC voltage is boosted to a high AC voltage $V_{OUT}$ by the power transformers, and the high AC voltage $V_{OUT}$ is sent to drive a system 190. The system 190 includes one or more CCFLs and/or one or more EEFLs. The system 190 provides a current and voltage feedback to the control subsystem 110.

As shown in FIG. 1, the system 190 includes one or more CCFLs and/or one or more EEFLs. These lamps can be used to provide backlight for an LCD panel. For a large LCD panel, a single-lamp backlight module often cannot provide sufficient backlighting. Consequently, a multi-lamp backlight module often is needed. For example, an LCD panel may require 20 to 40 lamps in order to provide high-intensity illumination for displaying full motion videos. From these lamps, the individual currents need to be balanced in order to maintain the display uniformity. For example, the current difference between different lamps should be maintained within a reasonable tolerance.

To balance lamp currents, some conventional techniques have been developed. For example, the conventional techniques use impedance matching schemes to build a balance controller for equalizing lamp currents. In another example, the conventional techniques use one or more common-mode chokes, which can balance the lamp currents. But these conventional systems can have various weaknesses in terms of flexibility, stability, and/or simplicity.

Hence it is highly desirable to improve techniques for multi-lamp driver system for CCFLs and/or EEFLs.

BRIEF SUMMARY OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

According to an embodiment, the present invention provides a system for driving a plurality of cold-cathode fluorescent lamps. The system includes a subsystem configured to receive at least a DC voltage and generate a first AC voltage in response to at least the DC voltage. The system also includes a power converter configured to receive the first AC voltage and convert the first AC voltage to at least a second AC voltage. The system further includes a plurality of current balancing devices. Each of the plurality of current balancing devices is configured to receive two currents and balance the two currents. The plurality of current balancing devices includes at least a first current balancing device, a second current balancing device, and a third current balancing device. In addition, the system includes a plurality of lamp pairs. The plurality of cold-cathode fluorescent lamp pairs includes at least a first pair, a second pair, and a third pair. The first pair, the second pair, and the third pair are in a parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current.

According to another embodiment, the present invention provides a system for driving a plurality of cold-cathode fluorescent lamps. The system includes a first power converter configured to receive the a first AC voltage and convert the first AC voltage to at least a second AC voltage. In addition, the system includes a second power converter configured to receive the a third AC voltage and convert the third AC voltage to at least a fourth AC voltage. The system further includes a current sensing component electrically coupled to the first power converter, the current sensor being configured to provide a signal. The system also includes a controller being configured to receive the signal. Furthermore, the system includes a plurality of current balancing devices, each of the plurality of current balancing devices being configured to receive two currents and balance the two currents. The plurality of current balancing devices includes at least a first current balancing device, a second current balancing device, and a third current balancing device. The system also includes a plurality of lamp pairs. The plurality of lamp pairs including at least a first pair, a second pair, and a third pair. The first pair, the second pair, and the third pair are in a parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current.

According to yet another embodiment, the present invention provides a system for driving a plurality of cold-cathode fluorescent lamps. The system includes a first power converter configured to receive the a first AC voltage and convert the first AC voltage to at least a second AC voltage. The system additionally includes a second power converter configured to receive the a third AC voltage and convert the third AC voltage to at least a fourth AC voltage. The system also includes a first current sensing component electrically coupled to the first power converter. The first current sensor is configured to provide a first feedback signal. The system additionally includes a second current sensing component electrically coupled to the second power converter, the second current sensing component being configured to provide a second feedback signal. In addition, the system includes a plurality of current balancing devices, each of the plurality of current balancing devices being configured to receive two currents and balance the two currents. The plurality of current balancing devices includes at least a first current balancing device, a second current balancing device, and a third current balancing device. Furthermore, the system includes a plurality of lamp pairs which includes at least a first pair, a second pair. The first pair, the second pair, and the third pair are in parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current.

According to yet another embodiment, the present invention provides a system for driving a plurality of cold-cathode fluorescent lamps. The system includes a first power converter configured to receive a first AC voltage and convert the first AC voltage to at least a second AC voltage. The system also includes a second power converter configured to receive a third AC voltage and convert the third AC voltage to at least a fourth AC voltage. The system also includes a third power converter configured to receive a first AC voltage and convert the first AC voltage to at least a fifth AC voltage. The system additionally includes a fourth power converter configured to receive a third AC voltage and convert the first AC voltage to at least a second AC voltage. The system also includes a plurality of current balancing devices, each of the plurality of current balancing devices being configured to receive two currents and balance the two currents. The plurality of current balancing devices includes at least a first current balancing device, a second current balancing device, and a third current balancing device. The system also includes a plurality of lamp pairs, the plurality of lamp pairs including at least a first pair, a second pair, a third pair, and a fourth pair. The first pair and the second pair are coupled to the first and the second power converters, the first pair and the second pair being in a parallel configuration. The third pair and the fourth pair are coupled to the third and the fourth power converters, the third pair and the fourth pair being in a parallel configuration. The first current balancing device is configured to balance the first pair and the second pair. The second current balancing device is configured to balance the third and the fourth pairs.

Many benefits are achieved by way of the present invention over conventional techniques. For example, some embodiments of the present invention provide a driver system that can balance currents between or among any number of lamps. Certain embodiments of the present invention provide a configuration in which only one or two inductive windings are in series with each lamp between the secondary winding of the transformer and the ground voltage. For example, the one or two inductive windings belong to one or two current balance chokes respectively. In another example, the currents flowing through at least majority of the lamps go through same types of circuit components. Some embodiments of the present invention provide great flexibility to the design and manufacturing of multi-lamp driver system. Certain embodiments of the present invention can improve stability and reliability of a multi-lamp driver system. Some embodiments of the present invention can simplify processes and lower costs for making a multi-lamp driver system. Certain embodiments of the present invention can balance both the currents flowing into some lamps and the currents flowing out of certain lamps. Some embodiments of the present invention can improve current balancing of a multi-lamp driver system by eliminating or reducing adverse effects by stray conductance or parasitic capacitance of the lamps. Certain embodiments of the present invention can provide current balancing to lamps driven by different transformers using cyclic current balance schemes. Some embodiments of the present invention can improve brightness uniformity on an LCD screen lit by a plurality of lamps that are driven by one or more transformers. According to a specific embodiment, the present invention provides a cost effective solution to balancing currents. For example, for N number lamps, only N/2 (or N/2−1) number of current balancing chokes is needed. Depending upon the embodiment, one or more of these benefits may be achieved. These and other benefits will be described in more detail throughout the present specification and more particularly below.

Various additional objects, features and advantages of the present invention can be more fully appreciated with reference to the detailed description and the accompanying drawings that follow.

DETAILED DESCRIPTION OF THE INVENTION

The present invention is directed to integrated circuits. More particularly, the invention provides a system and method with cyclic configuration. Merely by way of example, the invention has been applied to driving multiple cold-cathode fluorescent lamps, and/or external-electrode fluorescent lamps. But it would be recognized that the invention has a much broader range of applicability.

For multiple cold-cathode fluorescent lamps and/or external-electrode fluorescent lamps, current balancing often is needed in order to provide uniform brightness over a LCD panel. But the current balancing can be difficult to achieve. For example, the negative operating impedance and positive current-temperature characteristics of a lamp can accelerate current imbalance and eventually drive the multi-lamp backlight module into a runaway situation. The multi-lamp backlight module includes a plurality of lamps parallel to the same driving source. In another example, unmatched parasitic parameters of the lamps, especially the parasitic capacitance, can exacerbate the current imbalance. In yet another example, cross-coupling between lamps may also contribute to the current imbalance.

As discussed above, there are conventional techniques for balancing lamp currents, but these conventional techniques have various weaknesses. For example, some conventional techniques can work for only two lamps driven by the same power transformer. In another example, certain conventional technique use a pyramid topology for stacking common-mode chokes as the number of lamps increases. The pyramid structure can make the multi-lamp driver system unstable and can complicate the layout of printed circuit board (PCB).

In yet another example, certain conventional techniques use an increasing number of inductors as the number of lamps increases. These inductors are parts of the balance chokes, and are in series with each other. To achieve current balance, the inductance of each balance choke should equal to its mutual inductance because the voltage across the series of the inductors needs to equal zero. These constraints on the balance chokes may limit applications of the corresponding conventional techniques.

Figure 1:
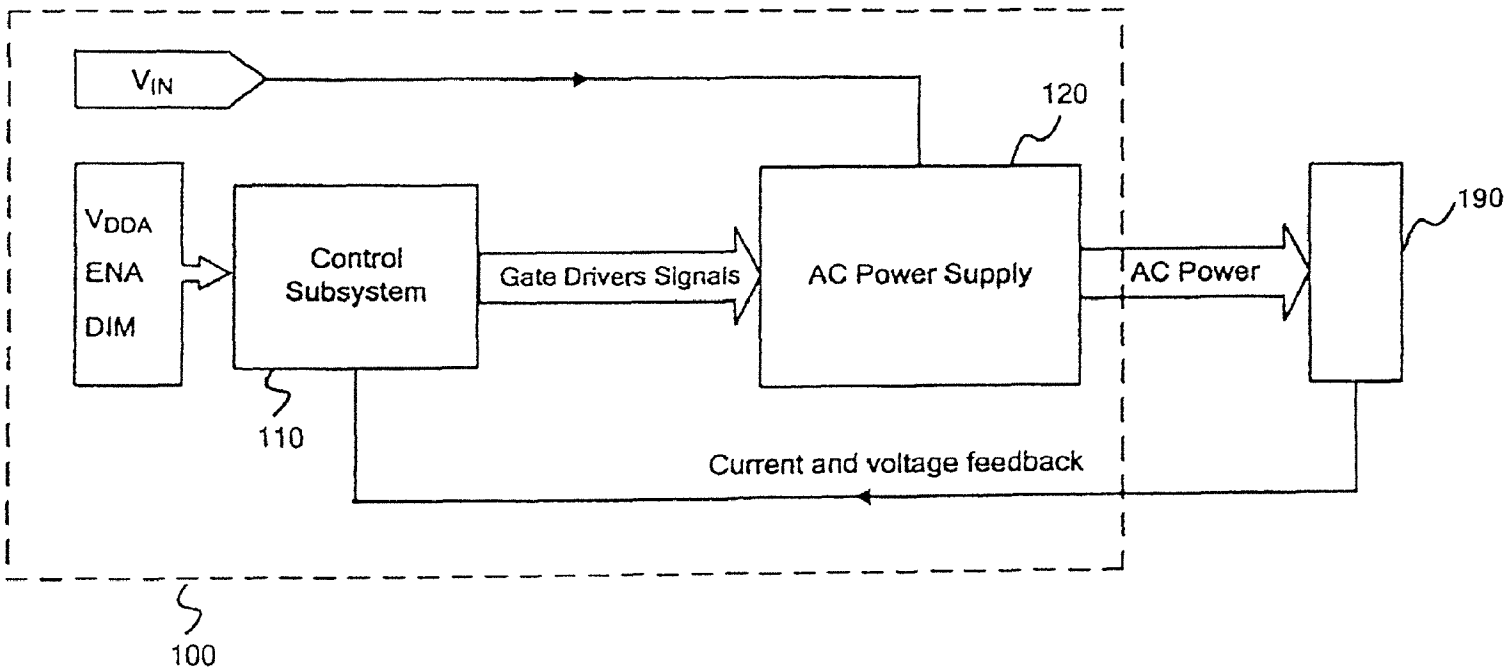
FIG. 1 (Prior Art)
FIG. 1 is a simplified conventional driver system for CCFL and/or EEFL.
Figure 2:
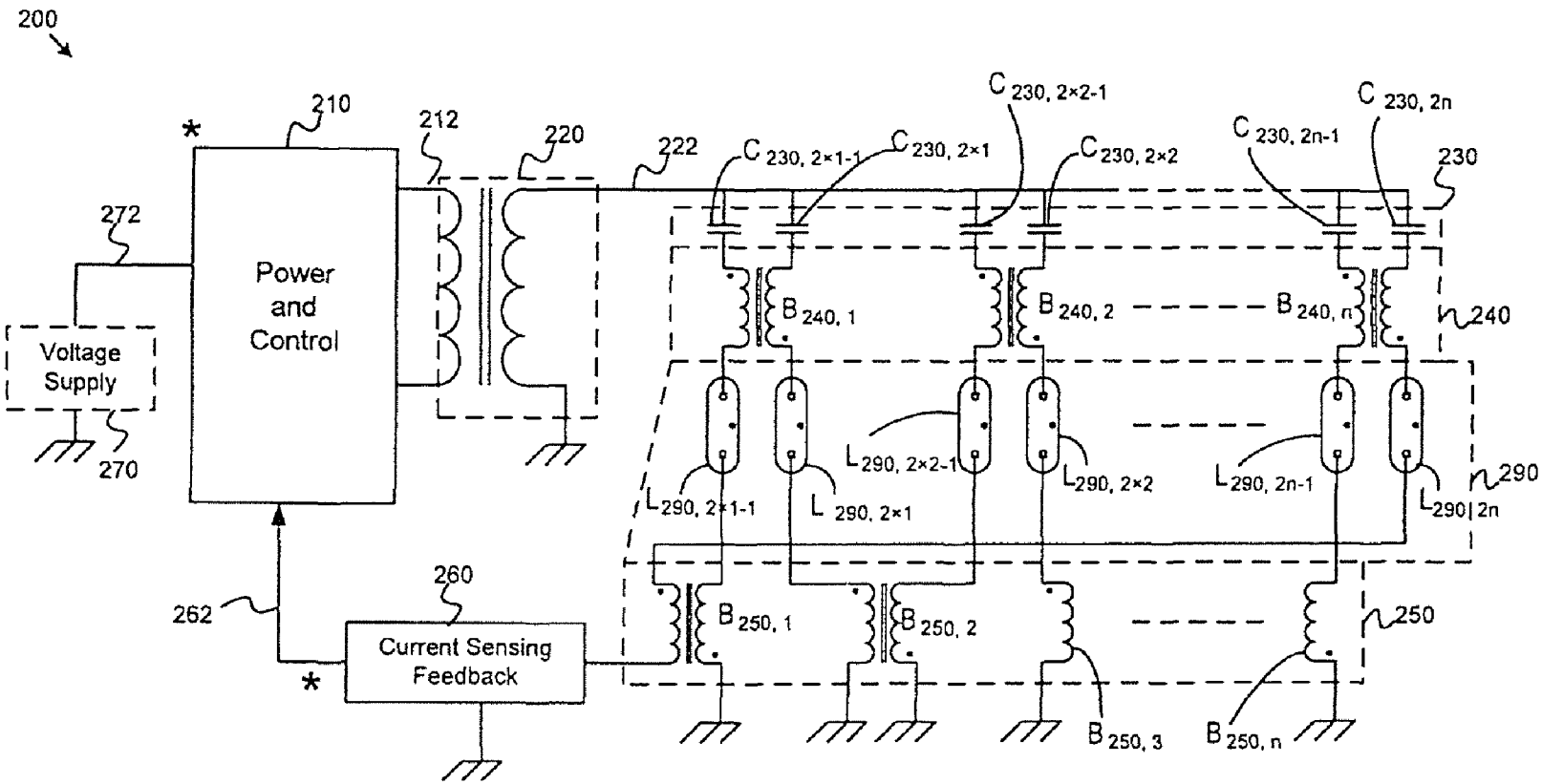
FIG. 2 is a simplified driver system according to an embodiment of the present invention.

FIG. 2 is a simplified driver system according to an embodiment of the present invention. This diagram is merely an example, which should not unduly limit the scope of the claims. One of ordinary skill in the art would recognize many variations, alternatives, and modifications. The driver system 200 includes a power and control subsystem 210, a power converter 220, the plurality of capacitors 230, one or more current balance chokes 240, one or more current balance chokes 250, a current sensing feedback component 260, and a voltage supply 270. Although the above has been shown using a selected group of components for the system 200, there can be many alternatives, modifications, and variations. For example, some of the components may be expanded and/or combined. Other components may be inserted to those noted above. Depending upon the embodiment, the arrangement of components may be interchanged with others replaced. For example, the system 200 is used to regulate a plurality of cold-cathode fluorescent lamps and/or external-electrode fluorescent lamps, such as a plurality of lamps 290. Further details of these components are found throughout the present specification and more particularly below.

The power and control subsystem 210 receives a voltage 272 from the voltage supply 270. For example, the voltage 272 is a DC voltage. In another example, the voltage 272 is equal to 5 volts. In response, the power and control subsystem 210 generates and provides an AC voltage 212 to the power converter 220.

According to an embodiment, the power and control subsystem 210 also receives certain control signals. For example, the control signals include an enabling (ENA) signal and a dimming (DIM) signal. In response, the power and control subsystem 210 generates one or more gate drive signals. Additionally, the power and control subsystem 210 includes one or more MOSFET transistors. These MOSFET transistors convert the voltage 272 to the AC voltage 212 in response to the one or more gate drive signals. According to another embodiment, the voltage supply 270 can use various types of configurations, such as Royer, push-pull, half-bridge, and/or full bridge.

The power converter 220 receives the AC voltage 212 and outputs an AC voltage 222 to the plurality of capacitors 230. According to one embodiment, the power converter 220 is a transformer. For example, the transformer includes a primary winding and a secondary winding. The primary winding receives the AC voltage 212 from the power and control subsystem 210, and the secondary winding outputs the AC voltage 222 to the one or more capacitors 230. For example, the secondary winding of the transformer has a much larger number of turns than the primary winding. According to another embodiment, the peak-to-peak amplitude of the AC voltage 222 is larger than the peak-to-peak amplitude of the AC voltage 212.

The plurality of capacitors 230 includes capacitors $C_{230,\ 2\times1-1}$, $C_{230,\ 2\times1}$, . . . , $C_{230,\ 2\times m-1}$, $C_{230,\ 2\times m}$, . . . , $C_{230,\ 2\times n-1}$, $C_{230,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 222, and the other of these two capacitor plates is coupled to the one or more current balance chokes 240.

The one or more current balance chokes 240 include current balance chokes $B_{240,1}, B_{240,2}, \ldots, B_{240,m}, \ldots, B_{240,n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one of these two windings is coupled to a capacitor plate of a capacitor, and the other of these two windings is coupled to a capacitor plate of another capacitor. For example, the current balance choke $B_{240,m}$, is coupled to capacitors $C_{230,2\times m-1}$ and $C_{230,2\times m}$.

The one or more current balance chokes 250 include current balance chokes $B_{250,1}, B_{250,2}, \ldots, B_{250,m}, \ldots, B_{250,n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one winding for the current balance choke $B_{250,1}$ is coupled to the current sensing feedback component 260, and the other winding for the current balance choke $B_{250,1}$ is coupled to a predetermined voltage level, such as the ground voltage. According to another embodiment, both windings for the current balance choke $B_{250,m}$ other than $B_{250,1}$ are coupled to a predetermined voltage level, such as the ground voltage.

The current sensing feedback component 260 provides a current sensing signal 262 to the power and control subsystem 210. For example, the power and control subsystem 210 uses the current sensing signal 262 to regulate the current flowing into and/or out of each of the plurality of lamps 290. In another example, the power and control subsystem 210 includes a PWM controller whose output pulse width is adjusted in accordance with the current sensing signal 262.

As discussed above, the system 200 is used to regulate the plurality of lamps 290 according to an embodiment of the present invention. For example, the plurality of lamps 290 includes one or more cold-cathode fluorescent lamps, and/or one or more external-electrode fluorescent lamps. In another example, the plurality of lamps 290 includes lamps $L_{290,2\times1-1}, L_{290,2\times1}, \ldots, L_{290,2\times m-1}, L_{290,2\times m}, \ldots, L_{290,2\times n-1}, L_{290,2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one winding of one of the one or more current balance chokes 240, and the other of the two terminals, e.g., a low-voltage terminal, is coupled to one winding of one of the one or more current balance chokes 250. In one embodiment, one winding of the current balance choke $B_{240,m}$ is coupled to one terminal of Lamp $L_{290,2\times m-1}$, and the other winding of the current balance choke $B_{240,m}$ is coupled to one terminal of Lamp $L_{290,2\times m}$. In another embodiment, if m is larger than 1, one winding of the current balance choke $B_{250,m}$ is coupled to one terminal of Lamp $L_{290,2\times(m-1)}$, and the other winding of the current balance choke $B_{250,m}$ is coupled to one terminal of Lamp $L_{290,2\times m-1}$. In yet another embodiment, one winding of the current balance choke $B_{250,1}$ is coupled to one terminal of Lamp $L_{290,2\times n}$, and the other winding of the current balance choke $B_{250,1}$ is coupled to one terminal of Lamp $L_{290,2\times1-1}$.

In another embodiment, the connections between the plurality of lamps 290 and the current balance chokes 240 and 250 are arranged in a cyclic configuration. For example, the high-voltage terminal of Lamp $L_{290,2\times m-1}$ and the high-voltage terminal for Lamp $L_{290,2\times m}$ are connected to the same current balance choke $B_{240,m}$. The current balance choke $B_{240,m}$ can make the currents flowing into the high voltage terminals of the Lamps $L_{290,2\times m-1}$ and $L_{290,2\times m}$ to be the same. In another example, if m is larger than 1, the low-voltage terminal of Lamp $L_{290,2\times(m-1)}$ and the low-voltage terminal of Lamp $L_{290,2\times m-1}$ are connected to the same current balance choke $B_{250,m}$. The current balance choke $B_{250,m}$ can make the currents flowing out of the low voltage terminals of the Lamps $L_{290,2\times(m-1)}$ and $L_{290,2\times m-1}$ to be the same. In yet another example, the low-voltage terminal of Lamp $L_{290,2\times n}$, and the low-voltage terminal of Lamp $L_{290,2\times1-1}$ are coupled to the same current balance choke $B_{250,1}$. The current balance choke $B_{250,1}$ can make the currents flowing out of the low voltage terminals of the Lamps $L_{290,2\times n}$ and $L_{290,2\times1-1}$ to be the same. In yet another embodiment, the system 200 can make currents flowing through the plurality of lamps 290 the same if a current flowing into a high-terminal of a lamp is substantially the same as another current flowing out of a low-voltage terminal of the same lamp.

As discussed above and further emphasized here, FIG. 2 is merely an example, which should not unduly limit the scope of the claims. One of ordinary skill in the art would recognize many variations, alternatives, and modifications. In one embodiment, the power and control subsystem 210 receives a voltage sensing signal, in addition to or instead of the current sensing signal 262. In another embodiment, the current sensing signal 262 represents the current from any single lamp selected from the plurality of lamps 290. In yet another embodiment, the current sensing signal 262 represents the total current of some or all of the plurality of lamps 290, and the total current can be regulated by the power and control subsystem 210.

According to another embodiment, the system 200 is used to regulate a plurality of lamps 290 including an odd number of lamps. For example, the plurality of lamps 290 includes lamps $L_{290,2\times1-1}, L_{290,2\times1}, \ldots, L_{290,2\times m-1}, L_{290,2\times m}, \ldots$, and $L_{290,2\times n-1}$. Additionally, the plurality of capacitors 230 includes capacitors $C_{230,2\times1-1}, C_{230,2\times1}, \ldots, C_{230,2\times m-1}, C_{230,2\times m}, \ldots, C_{230,2\times n-1}$. Moreover, the one or more current balance chokes 240 include current balance chokes $B_{240,1}, B_{240,2}, \ldots, B_{240,m}, \ldots, B_{240,n-1}$. Also, the one or more current balance chokes 250 include current balance chokes $B_{250,1}, B_{250,2}, \ldots, B_{250,m}, \ldots, B_{250,n}$. n is an integer larger than 1, and m is an integer equal to or larger than 1, and is equal to or smaller than n. In one embodiment, the high-voltage terminal of Lamp $L_{290,2\times n-1}$ is coupled to a capacitor plate of the capacitor $C_{230,2\times n-1}$. In another embodiment, the low-voltage terminal of Lamp $L_{290,2\times n-1}$, and the low-voltage terminal of Lamp $L_{290,2\times1-1}$ are coupled to the same current balance choke $B_{250,1}$. The current balance choke $B_{250,1}$ can make the currents flowing out of the low voltage terminals of the Lamps $L_{290,2\times n-1}$ and $L_{290,2\times1-1}$ to be the same. In yet another embodiment, the current balance choke $B_{250,1}$ and the low-voltage terminal of Lamp $L_{290,2\times(n-1)}$ are coupled to the current balance choke $B_{250,n}$. The current balance choke $B_{250,1}$ can make the currents flowing out of the low voltage terminals of the Lamps $L_{290,2\times n-1}$ and $L_{290,2\times1-1}$ to be the same. For example, the current from Lamp $L_{290,\ 2\times n(n-1)}$ flows through one winding of the current balance choke $B_{250,\ 1}$ and then flow through one winding of the current balance choke $B_{250,\ n}$. Accordingly, the current balance choke $B_{250,\ n}$ can make the currents flowing out of the low voltage terminals of the Lamps $L_{290,\ 2\times(n-1)}$ and $L_{290,\ 2\times n-1}$ to be the same.

Figure 3:
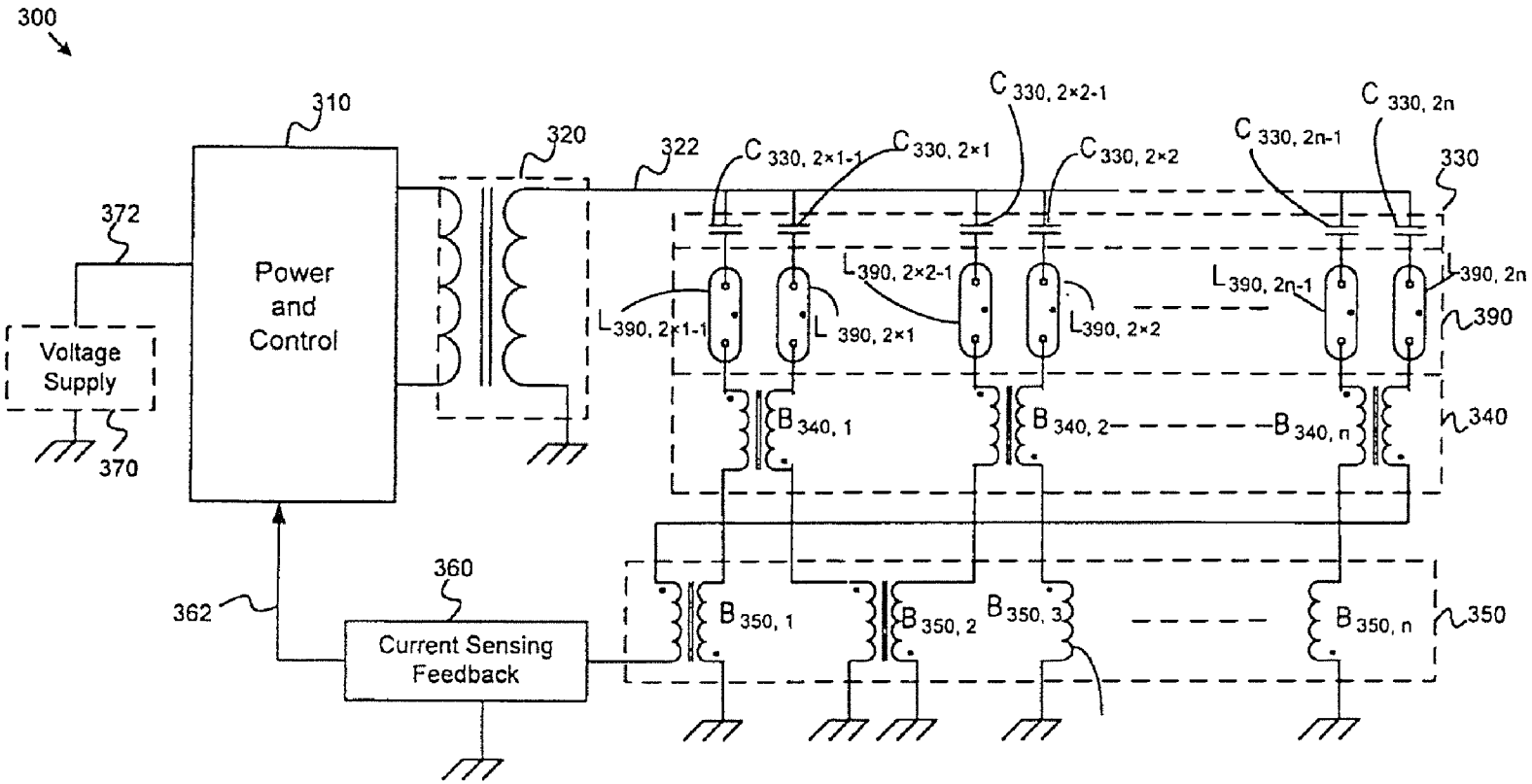
FIG. 3 is a simplified driver system according to another embodiment of the present invention.

FIG. 3 is a simplified driver system according to another embodiment of the present invention. This diagram is merely an example, which should not unduly limit the scope of the claims. One of ordinary skill in the art would recognize many variations, alternatives, and modifications. The driver system 300 includes a power and control subsystem 310, a power converter 320, the plurality of capacitors 330, one or more current balance chokes 340, one or more current balance chokes 350, a current sensing feedback component 360, and a voltage supply 370. Although the above has been shown using a selected group of components for the system 300, there can be many alternatives, modifications, and variations. For example, some of the components may be expanded and/or combined. Other components may be inserted to those noted above. Depending upon the embodiment, the arrangement of components may be interchanged with others replaced. For example, the system 300 is used to regulate a plurality of cold-cathode fluorescent lamps and/or external-electrode fluorescent lamps, such as a plurality of lamps 390. Further details of these components are found throughout the present specification and more particularly below.

The power and control subsystem 310 receives a voltage 372 from the voltage supply 370. For example, the voltage 372 is a DC voltage. In another example, the voltage 372 is equal to 5 volts. In response, the power and control subsystem 310 generates and provides an AC voltage 312 to the power converter 320.

According to an embodiment, the power and control subsystem 310 also receives certain control signals. For example, the control signals include an enabling (ENA) signal and a dimming (DIM) signal. In response, the power and control subsystem 310 generates one or more gate drive signals. Additionally, the power and control subsystem 310 includes one or more MOSFET transistors. These MOSFET transistors convert the voltage 372 to the AC voltage 312 in response to the one or more gate drive signals. According to another embodiment, the voltage supply 370 can use various types of configurations, such as Royer, push-pull, half-bridge, and/or full bridge.

The power converter 320 receives the AC voltage 312 and outputs an AC voltage 322 to the plurality of capacitors 330. According to one embodiment, the power converter 320 is a transformer. For example, the transformer includes a primary winding and a secondary winding. The primary winding receives the AC voltage 312 from the power and control subsystem 310, and the secondary winding outputs the AC voltage 322 to the one or more capacitors 330. For example, the secondary winding of the transformer has a much larger number of turns than the primary winding. According to another embodiment, the peak-to-peak amplitude of the AC voltage 322 is larger than the peak-to-peak amplitude of the AC voltage 312.

The plurality of capacitors 330 includes capacitors $C_{330,\ 2\times1-1}$, $C_{330,\ 2\times1}$, . . . , $C_{330,\ 2\times m-1}$, $C_{330,\ 2\times m}$, . . . , $C_{330,\ 2\times n-1}$, $C_{330,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 322.

The one or more current balance chokes 340 include current balance chokes $B_{340,\ 1}$, $B_{340,\ 2}$, . . . , $B_{340,\ m}$, . . . , $B_{340,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core.

The one or more current balance chokes 350 include current balance chokes $B_{350,\ 1}$, $B_{350,\ 2}$, . . . , $B_{350,\ m}$, . . . , $B_{350,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one winding for the current balance choke $B_{350,\ 1}$ is coupled to the current sensing feedback component 360, and the other winding for the current balance choke $B_{350,\ 1}$ is coupled to a predetermined voltage level, such as the ground voltage. According to another embodiment, both windings for the current balance choke $B_{250,\ m}$ other than $B_{250,\ 1}$ are coupled to a predetermined voltage level, such as the ground voltage.

According to an embodiment, if m is larger than 1, one winding of the current balance choke $B_{350,\ m}$ is coupled to one winding of the current balance choke $B_{340,\ m-1}$, and the other winding of the current balance choke $B_{350,\ m}$ is coupled to one winding of the current balance choke $B_{340,\ m}$. According to another embodiment, one winding of the current balance choke $B_{350,\ 1}$ is coupled to one winding of the current balance choke $B_{340,\ n}$, and the other winding of the current balance choke $B_{350,\ 1}$ is coupled to one winding of the current balance choke $B_{340,\ 1}$.

The current sensing feedback component 360 provides a current sensing signal 362 to the power and control subsystem 310. For example, the power and control subsystem 310 uses the current sensing signal 362 to regulate the current flowing into and/or out of each of the plurality of lamps 390. In another example, the power and control subsystem 310 includes a PWM controller whose output pulse width is adjusted in accordance with the current sensing signal 362.

As discussed above, the system 300 is used to regulate the plurality of lamps 390 according to an embodiment of the present invention. For example, the plurality of lamps 390 includes one or more cold-cathode fluorescent lamps, and/or one or more external-electrode fluorescent lamps. In another example, the plurality of lamps 390 includes lamps $L_{390,\ 2\times1-1}$, $L_{390,\ 2\times1}$, . . . , $L_{390,\ 2\times m-1}$, $L_{390,\ 2\times m}$, . . . , $L_{390,\ 2\times n-1}$, $L_{390,\ 2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one capacitor plate of one of the plurality of capacitors 330, and the other of the two terminals, e.g., a low-voltage terminal, is coupled to one winding of one of the one or more current balance chokes 340. In another example, the high-voltage terminal of Lamp $L_{390,\ 2\times m-1}$ is coupled to the capacitor $C_{330,\ 2\times m-1}$, and the high-voltage terminal of Lamp $L_{390,\ 2\times m}$ is coupled to the capacitor $C_{330,\ 2\times m}$. Additionally, the low-voltage terminals of Lamps $L_{390,\ 2\times m-1}$ and $L_{390,\ 2\times m}$ are coupled to the current balance choke $B_{340,\ m}$.

In another embodiment, the connections among the plurality of lamps 390, the current balance chokes 340, and the current balance chokes 350 are arranged in a cyclic configuration. For example, the current from low-voltage terminal of Lamp $L_{390,\ 2\times m-1}$ flows through one winding of the current balance choke $B_{340,\ m}$, and one winding of the current balance choke $B_{350,\ m}$. In another example, if m is smaller than n, the current from low-voltage terminal of Lamp $L_{390,\ 2\times m}$ flows through one winding of the current balance choke $B_{340,\ m}$, and one winding of the current balance choke $B_{350,\ m+1}$. In yet another example, if m is equal to n, the current from low-voltage terminal of Lamp $L_{390,\ 2\times n}$ flows through one winding of the current balance choke $B_{340,\ m}$, and one winding of the current balance choke $B_{350,\ 1}$. In yet another embodiment, the system 300 can make currents flowing from the plurality of lamps 390 the same as shown in FIG. 3.

As discussed above and further emphasized here, FIG. 3 is merely an example, which should not unduly limit the scope of the claims. One of ordinary skill in the art would recognize many variations, alternatives, and modifications. In one embodiment, the power and control subsystem 310 receives a voltage sensing signal, in addition to or instead of the current sensing signal 362. In another embodiment, the current sensing signal 362 represents the current from any single lamp selected from the plurality of lamps 390. In yet another embodiment, the current sensing signal 362 represents the total current of some or all of the plurality of lamps 390, and the total current can be regulated by the power and control subsystem 310.

According to another embodiment, the system 300 is used to regulate a plurality of lamps 390 including an odd number of lamps. For example, the plurality of lamps 390 includes lamps $L_{390,\ 2\times1-1}$, $L_{390,\ 2}$, . . . , $L_{390,\ 2\times m-1}$, $L_{390,\ 2\times m}$, . . . , and $L_{390,\ 2\times n-1}$. Additionally, the plurality of capacitors 330 includes capacitors $C_{330,\ 2\times1-1}$, $C_{330,\ 2\times1}$, . . . , $C_{330,\ 2\times m-1}$, $C_{330,\ 2\times m}$, . . . , $C_{330,\ 2\times n-1}$. Moreover, the one or more current balance chokes 340 include current balance chokes $B_{340,\ 1}$, $B_{340,\ 2}$, . . . , $B_{340,\ m}$, . . . , $B_{340,\ n-1}$. Also, the one or more current balance chokes 350 include current balance chokes $B_{350,\ 1}$, $B_{340,\ 2}$, . . . , $B_{350,\ m}$, . . . , $B_{350,\ n}$. n is an integer larger than 1, and m is an integer equal to or larger than 1, and is equal to or smaller than n. For example, if m is smaller than n, the current from low-voltage terminal of Lamp $L_{390,\ 2\times m-1}$ flows through one winding of the current balance choke $B_{340,\ m}$, and one winding of the current balance choke $B_{350,\ m}$. Additionally, the current from the low-voltage terminal of Lamp $L_{390,\ 2\times n-1}$ flows through one winding of the current balance choke $B_{350,\ 1}$, and the current from the low-voltage terminal of Lamp $L_{390,\ 1}$ flows through one winding of the current balance choke $B_{340,\ 1}$ and one winding of the current balance choke $B_{350,\ 1}$. Accordingly, the current balance choke $B_{350,\ 1}$ can make currents from the low-voltage terminal of Lamp $L_{390,\ 2\times n-1}$ and the low-voltage terminal of Lamp $L_{390,\ 1}$ the same.

In another example, the current from the low-voltage terminal of Lamp $L_{390,\ 2\times(n-1)}$ flows through one winding of the current balance choke $B_{340,\ n-1}$ and one winding of the current balance choke $B_{350,\ n}$. Additionally, the current balance choke $B_{350,\ 1}$ and the current balance choke $B_{340,\ n-1}$ are coupled to the current balance choke $B_{350,\ n}$. Accordingly, the current balance choke $B_{350,\ n}$ can make the currents flowing out of the low voltage terminals of the Lamps $L_{390,\ 2\times(n-1)}$ and $L_{390,\ 2\times n-1}$ to be the same.

Figure 4:
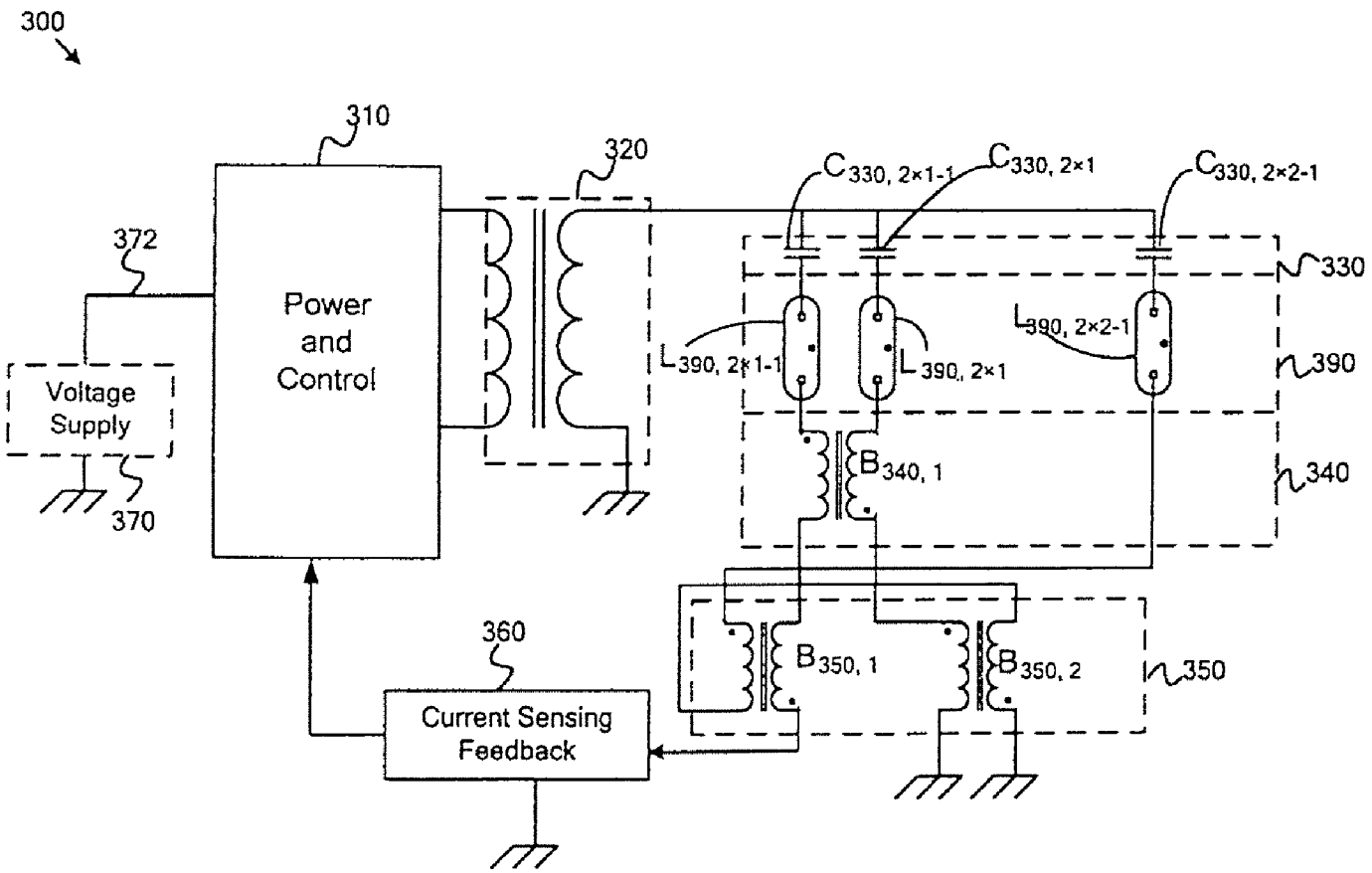
FIG. 4 is a simplified driver system according to yet another embodiment of the present invention.

FIG. 4 is a simplified driver system 300 according to yet another embodiment of the present invention. This diagram is merely an example, which should not unduly limit the scope of the claims. One of ordinary skill in the art would recognize many variations, alternatives, and modifications. As shown in FIG. 4, the driver system 300 is used to regulate a plurality of lamps 390 including three lamps. For example, the plurality of lamps 390 includes lamps $L_{390,\ 2\times1-1}$, $L_{390,\ 2\times1}$, and $L_{390,\ 2\times2-1}$. Additionally, the plurality of capacitors 330 includes capacitors $C_{330,\ 2\times1-1}$, $C_{330,\ 2\times1}$, and $C_{330,\ 2\times2-1}$. Moreover, the one or more current balance chokes 340 include the current balance choke $B_{340,\ 1}$. Also, the one or more current balance chokes 350 include current balance chokes $B_{350,\ 1}$ and $B_{350,\ 2}$. For example, the current from low-voltage terminal of Lamp $L_{390,\ 2\times1-1}$ flows through one winding of the current balance choke $B_{340,\ 1}$, and one winding of the current balance choke $B_{350,\ 1}$. Additionally, the current from the low-voltage terminal of Lamp $L_{390,\ 2\times2-1}$ flows through one winding of the current balance choke $B_{350,\ 1}$, and the current from the low-voltage terminal of Lamp $L_{390,\ 1}$ flows through one winding of the current balance choke $B_{340,\ 1}$ and one winding of the current balance choke $B_{350,\ 1}$. Accordingly, the current balance choke $B_{350,\ 1}$ can make currents from the low-voltage terminal of Lamp $L_{390,\ 2\times2-1}$ and the low-voltage terminal of Lamp $L_{390,\ 1}$ the same. In another example, the current from the low-voltage terminal of Lamp $L_{390,\ 2}$ flows through one winding of the current balance choke $B_{340,\ 1}$ and one winding of the current balance choke $B_{350,\ 2}$. Additionally, the current balance choke $B_{350,\ 1}$ and the current balance choke $B_{340,\ 1}$ are coupled to the current balance choke $B_{350,\ 2}$. Accordingly, the current balance choke $B_{350,\ 2}$ can make the currents flowing out of the low voltage terminals of the Lamps $L_{390,\ 2}$ and $L_{390,\ 3}$ to be the same.

Figure 5:
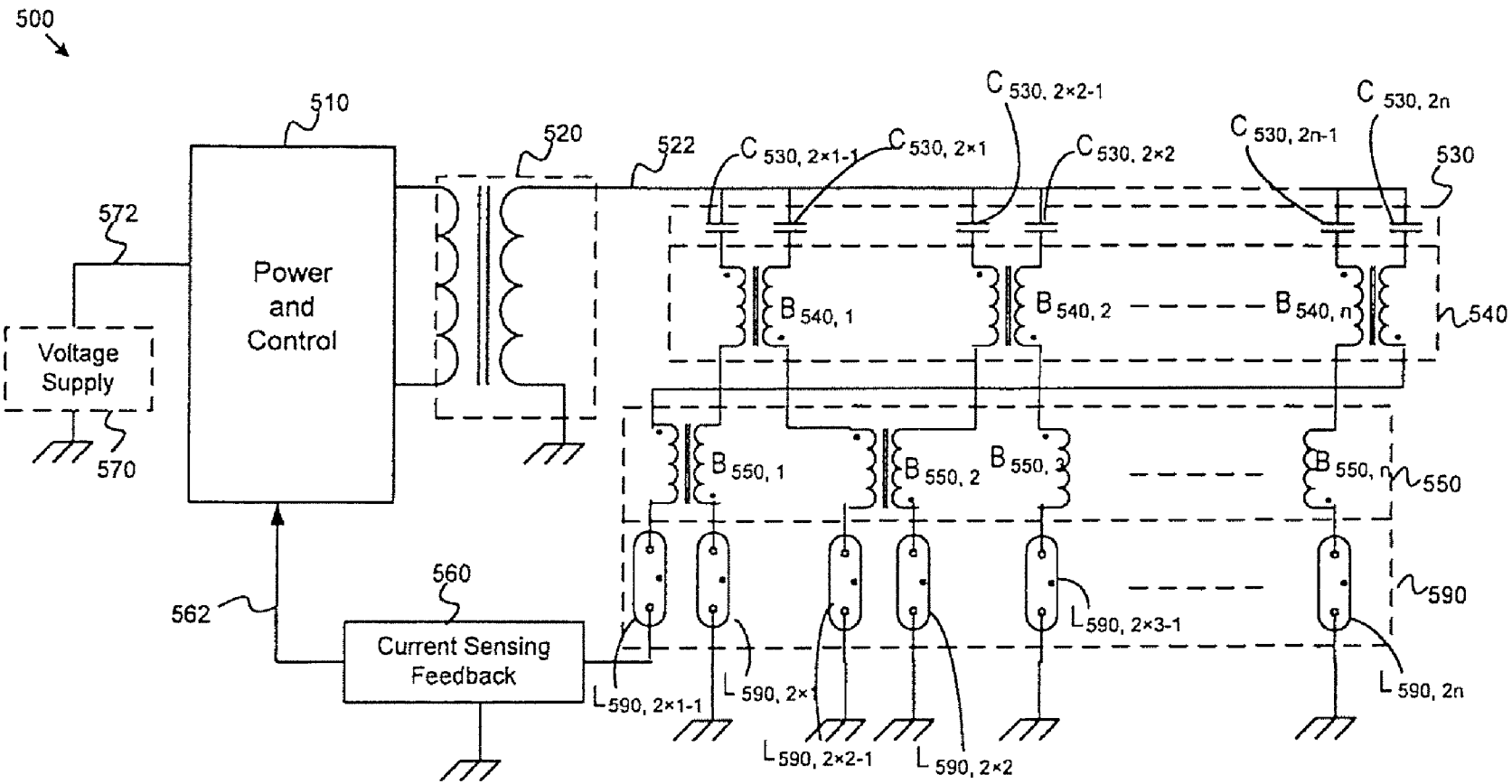
FIG. 5 is a simplified driver system according to yet another embodiment of the present invention.

FIG. 5 is a simplified driver system according to yet another embodiment of the present invention. This diagram is merely an example, which should not unduly limit the scope of the claims. One of ordinary skill in the art would recognize many variations, alternatives, and modifications. The driver system 500 includes a power and control subsystem 510, a power converter 520, the plurality of capacitors 530, one or more current balance chokes 540, one or more current balance chokes 550, a current sensing feedback component 560, and a voltage supply 570. Although the above has been shown using a selected group of components for the system 500, there can be many alternatives, modifications, and variations. For example, some of the components may be expanded and/or combined. Other components may be inserted to those noted above. Depending upon the embodiment, the arrangement of components may be interchanged with others replaced. For example, the system 500 is used to regulate a plurality of cold-cathode fluorescent lamps and/or external-electrode fluorescent lamps, such as a plurality of lamps 590. Further details of these components are found throughout the present specification and more particularly below.

The power and control subsystem 510 receives a voltage 572 from the voltage supply 570. For example, the voltage 572 is a DC voltage. In another example, the voltage 572 is equal to 5 volts. In response, the power and control subsystem 510 generates and provides an AC voltage 512 to the power converter 520.

According to an embodiment, the power and control subsystem 510 also receives certain control signals. For example, the control signals include an enabling (ENA) signal and a dimming (DIM) signal. In response, the power and control subsystem 510 generates one or more gate drive signals. Additionally, the power and control subsystem 510 includes one or more MOSFET transistors. These MOSFET transistors convert the voltage 572 to the AC voltage 512 in response to the one or more gate drive signals. According to another embodiment, the voltage supply 570 can use various types of configurations, such as Royer, push-pull, half-bridge, and/or full bridge.

The power converter 520 receives the AC voltage 512 and outputs an AC voltage 522 to the plurality of capacitors 530. According to one embodiment, the power converter 520 is a transformer. For example, the transformer includes a primary winding and a secondary winding. The primary winding receives the AC voltage 512 from the power and control subsystem 510, and the secondary winding outputs the AC voltage 522 to the one or more capacitors 530. For example, the secondary winding of the transformer has a much larger number of turns than the primary winding. According to another embodiment, the peak-to-peak amplitude of the AC voltage 522 is larger than the peak-to-peak amplitude of the AC voltage 512.

The plurality of capacitors 530 includes capacitors $C_{530,\ 2\times1-1}$, $C_{530,\ 2\times1}$, . . . , $C_{530,\ 2\times m-1}$, $C_{530,\ 2\times m}$, . . . , $C_{530,\ 2\times n-1}$, $C_{530,\ 2\times n}$. n is an integer equal to or larger than 1, and m is an integer equal to or larger than 1, and is equal to or smaller than n. In one embodiment, each capacitor includes two capacitor plates. One of these two capacitor plates receives the AC voltage 522, and the other of these two capacitor plates is coupled to the one or more current balance chokes 540.

The one or more current balance chokes 540 include current balance chokes $B_{540,\ 1}$, $B_{540,\ 2}$, . . . , $B_{540,\ m}$, . . . , $B_{540,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core. According to an embodiment, one of these two windings is coupled to a capacitor plate of a capacitor, and the other of these two windings is coupled to a capacitor plate of another capacitor. For example, the current balance choke $B_{540,\ m}$ is coupled to capacitors $C_{530,\ 2\times m-1}$ and $C_{530,\ 2\times m}$.

The one or more current balance chokes 550 include current balance chokes $B_{550,\ 1}$, $B_{550,\ 2}$, . . . , $B_{550,\ m}$, . . . , $B_{550,\ n}$. n is an integer equal to or larger than 1, and m is an integer equal to or larger than 1, and is equal to or smaller than n. For example, each current balance choke is a common-mode choke. In another example, each current balance choke is a balun choke. In yet another example, each current balance choke includes a magnetic core and two windings. Each of these two windings are wound on the magnetic core.

According to an embodiment, if m is larger than 1, one winding of the current balance choke $B_{550,\ m}$ is coupled to one winding of the current balance choke $B_{540,\ m-1}$, and the other winding of the current balance choke $B_{550,\ m}$ is coupled to one winding of the current balance choke $B_{540,\ m}$. According to another embodiment, one winding of the current balance choke $B_{550,\ 1}$ is coupled to one winding of the current balance choke $B_{540,\ n}$, and the other winding of the current balance choke $B_{550,\ 1}$ is coupled to one winding of the current balance choke $B_{540,\ 1}$.

The current sensing feedback component 560 provides a current sensing signal 562 to the power and control subsystem 510. For example, the power and control subsystem 510 uses the current sensing signal 562 to regulate the current flowing into and/or out of each of the plurality of lamps 590. In another example, the power and control subsystem 510 includes a PWM controller whose output pulse width is adjusted in accordance with the current sensing signal 562.

As discussed above, the system 500 is used to regulate the plurality of lamps 590 according to an embodiment of the present invention. For example, the plurality of lamps 590 includes one or more cold-cathode fluorescent lamps, and/or one or more external-electrode fluorescent lamps. In another example, the plurality of lamps 590 includes lamps $L_{590,\ 2\times1-1}$, $L_{590,\ 2\times1}$, . . . , $L_{590,\ 2\times m-1}$, $L_{590,\ 2\times m}$, . . . , $L_{590,\ 2\times n}$, $L_{590,\ 2\times n}$. n is an integer equal to or larger than 1, and m is an integer equal to or larger than 1, and is equal to or smaller than n.

In one embodiment, each lamp includes two terminals. For example, one of the two terminals, e.g., a high-voltage terminal, is coupled to one winding of the one or more current balance chokes 550. In another example, the low-voltage terminal of Lamp $L_{590,\ 2\times m}$ is coupled to coupled to a predetermined voltage level, such as the ground voltage. In yet another example, if m is larger than 1, the low-voltage terminal of Lamp $L_{590,\ 2\times m-1}$ is coupled to a predetermined voltage level, such as the ground voltage. In yet another example, the low-voltage terminal of Lamp $L_{390,\ 2\times1-1}$ is coupled to the current sensing feedback component 560.

In another embodiment, the connections among the plurality of lamps 590, the current balance chokes 540, and the current balance chokes 550 are arranged in a cyclic configuration. For example, the current flowing into high-voltage terminal of Lamp $L_{590,\ 2\times m}$ flows through one winding of the current balance choke $B_{540,\ m}$, and one winding of the current balance choke $B_{550,\ m}$. In another example, if m is larger than 1, the current flowing into high-voltage terminal of Lamp $L_{590,\ 2\times m-1}$ flows through one winding of the current balance choke $B_{540,\ m-1}$, and one winding of the current balance choke $B_{550,\ m}$. In yet another example, if m is equal to 1, the current flowing into high-voltage terminal of Lamp $L_{390,\ 2\times1-1}$ flows through one winding of the current balance choke $B_{540,\ 1}$, and one winding of the current balance choke $B_{550,\ m}$. In yet another embodiment, the system 500 can make currents flowing into the plurality of lamps 590 the same as shown in FIG. 5.

As discussed above and further emphasized here, FIG. 5 is merely an example, which should not unduly limit the scope of the claims. One of ordinary skill in the art would recognize many variations, alternatives, and modifications. In one embodiment, the power and control subsystem 510 receives a voltage sensing signal, in addition to or instead of the current sensing signal 562. In another embodiment, the current sensing signal 562 represents the current from any single lamp selected from the plurality of lamps 590. In yet another embodiment, the current sensing signal 562 represents the total current of some or all of the plurality of lamps 590, and the total current can be regulated by the power and control subsystem 510.

According to another embodiment, the system 300 is used to regulate the plurality of lamps 590 including an odd number of lamps. For example, the plurality of lamps 590 includes lamps $L_{590,\ 2\times1-1}$, $L_{590,\ 2\times1}$, . . . , $L_{590,\ 2\times m-1}$, $L_{590,\ 2\times m}$, . . . , and $L_{590,\ 2\times n-1}$. n is an integer larger than 1, and m is an integer equal to or larger than 1, and is equal to or smaller than n.

FIGS. 2, 3, 4, and 5 are merely examples, which should not unduly limit the scope of the claims. One of ordinary skill in the art would recognize many variations, alternatives, and modifications. For example, the plurality of capacitors 230, 330, or 530 are coupled to a plurality of transformers. In another example, the plurality of transformers are used to regulate the plurality of cold-cathode fluorescent lamps and/or external-electrode fluorescent lamps, such as a plurality of lamps 290, 390, or 590.

Figure 6:
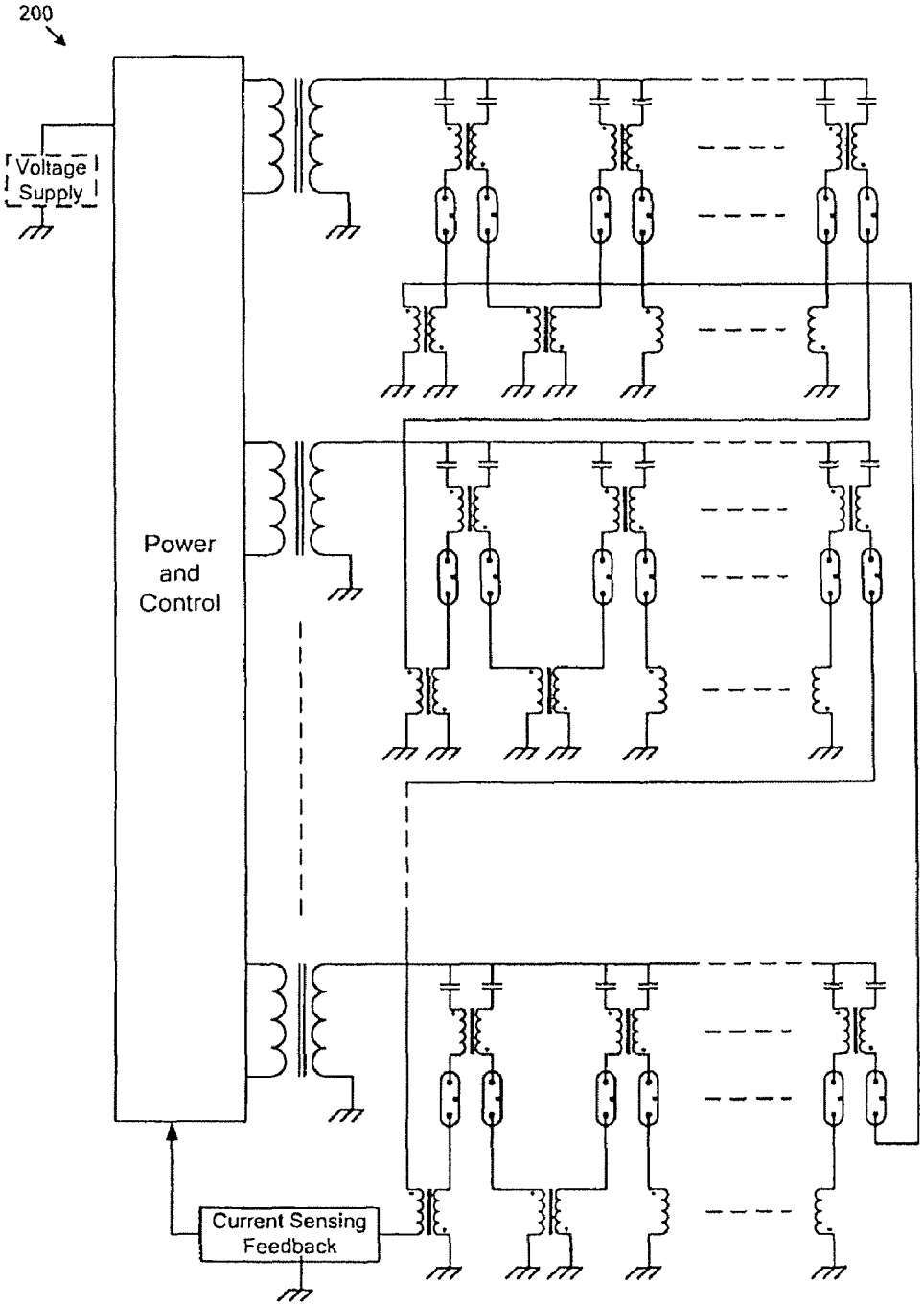
FIG. 6 is a simplified driver system according to yet another embodiment of the present invention.

FIG. 6 is a simplified driver system 200 according to yet another embodiment of the present invention. This diagram is merely an example, which should not unduly limit the scope of the claims. One of ordinary skill in the art would recognize many variations, alternatives, and modifications. The driver system 200 includes a power and control subsystem, a power converter, the plurality of capacitors, one or more current balance chokes, one or more current balance chokes, a current sensing feedback component, and a voltage supply. For example, the power converter includes a plurality of transformers, whose primary windings are coupled to the power and control subsystem and whose secondary windings are coupled to different capacitors selected from the plurality of capacitors.

Figure 7:
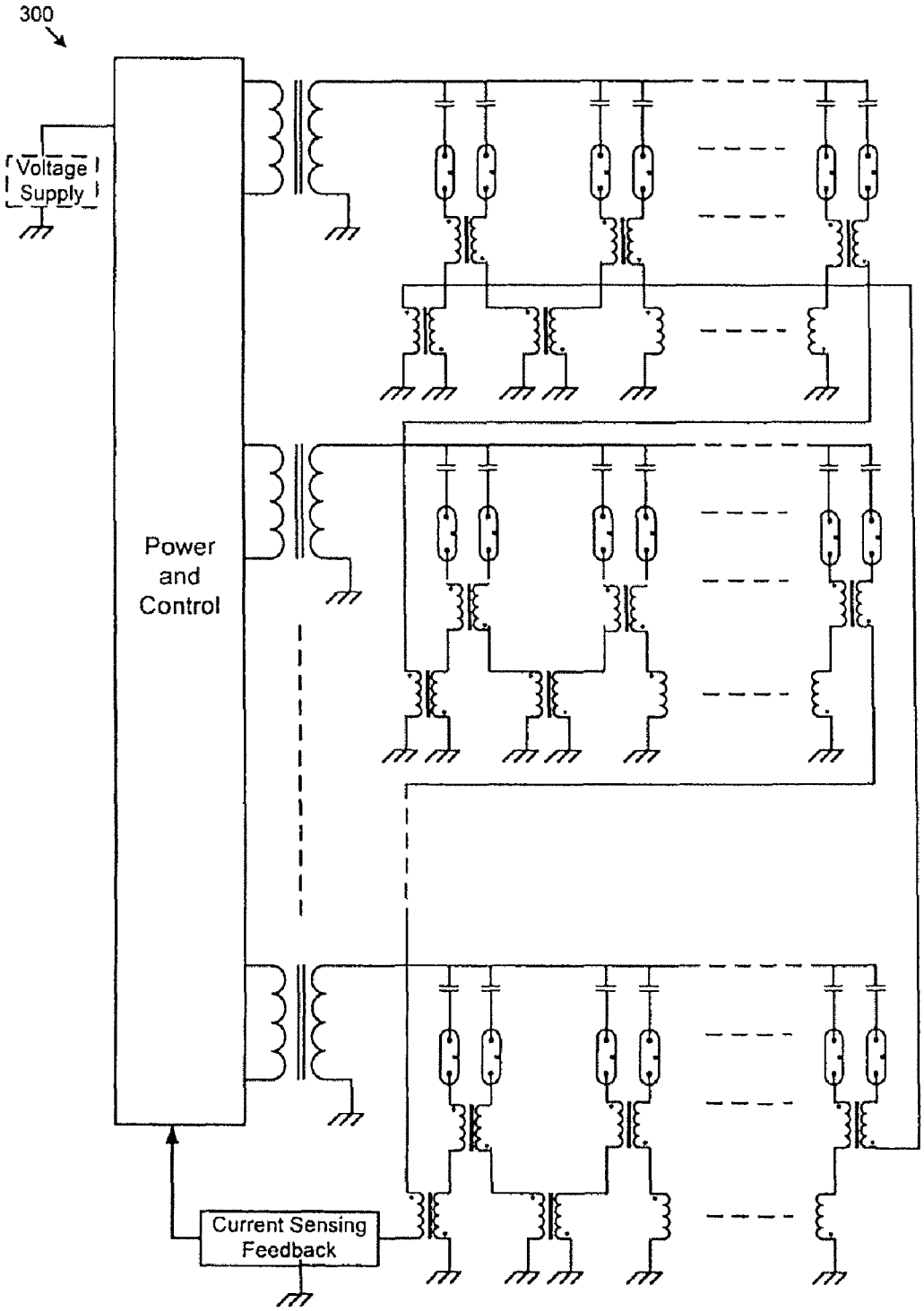
FIG. 7 is a simplified driver system 300 according to yet another embodiment of the present invention.

FIG. 7 is a simplified driver system 300 according to yet another embodiment of the present invention. This diagram is merely an example, which should not unduly limit the scope of the claims. One of ordinary skill in the art would recognize many variations, alternatives, and modifications. The driver system 300 includes a power and control subsystem, a power converter, the plurality of capacitors, one or more current balance chokes, one or more current balance chokes, a current sensing feedback component, and a voltage supply. For example, the power converter includes a plurality of transformers, whose primary windings are coupled to the power and control subsystem and whose secondary windings are coupled to different capacitors selected from the plurality of capacitors.

Figure 8:
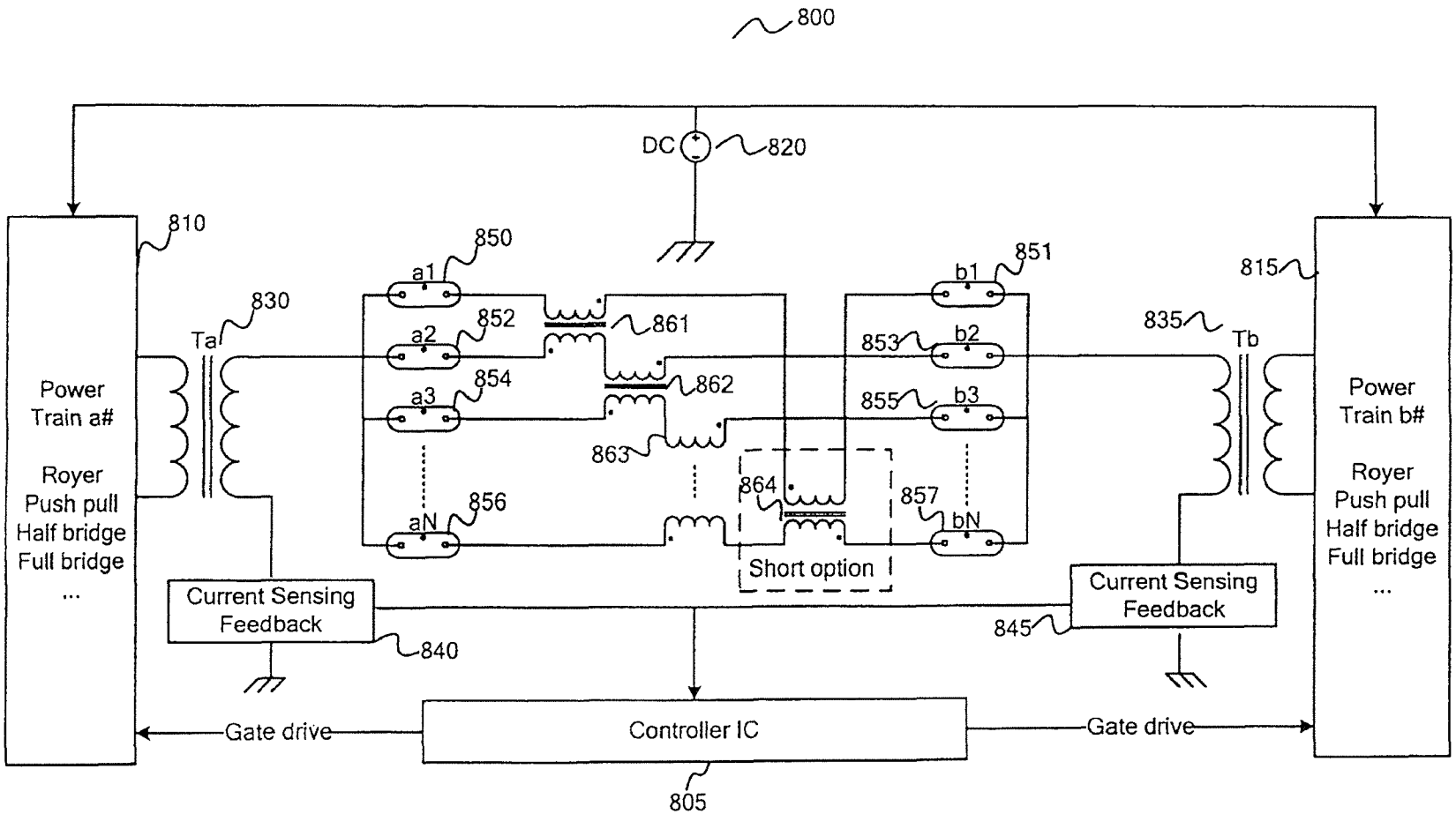
FIG. 8 is a simplified diagram illustrating a driver system according to an embodiment of the present invention.

FIG. 8 is a simplified diagram illustrating a driver system according to an embodiment of the present invention. This diagram is merely an example, which should not unduly limit the scope of the claims. One of ordinary skill in the art would recognize many variations, alternatives, and modifications.

As shown, a driver system 800 includes the following components:

1. a controller 805;
2. power and control subsystems 810 and 815;
3. power converters 830 and 835;
4. current balance chokes 860-864;
5. current sensing feedback component 840 and 845;
6. a DC source 820; and
7. lamps 850-857.

Although the above has been shown using a selected group of components for the system 800, there can be many alternatives, modifications, and variations. For example, some of the components may be expanded and/or combined. Other components may be inserted to those noted above. Depending upon the embodiment, the arrangement of components may be interchanged with others replaced. For example, the system 800 is used to regulate a plurality of cold-cathode fluorescent lamps and/or external-electrode fluorescent lamps, such as lamps 850-857. Further details of these components are found throughout the present specification and more particularly below.

The power and control subsystems 810 and 815 receive a voltage from the DC source 820. For example, the voltage is a DC voltage. In another example, the voltage is approximately 5 volts. In response, the power and control subsystems 810 and 815 generates and provides an AC voltage to the power converters 830 and 835. According to a specific example, the performance and characteristics of the power and control subsystems are substantially matched.

According to an embodiment, the power and control subsystems 810 and 815 also receives certain control signals. For example, the control signals include an enabling (ENA) signal and a dimming (DIM) signal. In response, the power and control subsystems 810 and 815 generate one or more gate drive signals. Additionally, the power and control subsystems 810 and 815 includes one or more MOSFET transistors. These MOSFET transistors convert the DC voltage to AC voltage in response to the one or more gate drive signals. According to another embodiment, the DC source 820 can use various types of configurations, such as Royer, push-pull, half-bridge, and/or full bridge.

The power converter 830 receives the AC voltage and outputs an AC voltage to pairs of lamps. According to one embodiment, the power converter 830 is a transformer. For example, the transformer includes a primary winding and a secondary winding. The primary winding receives the AC voltage from the power and control subsystem 810, and the secondary winding outputs the AC voltage to the lamps. For example, the secondary winding of the transformer has a much larger number of turns than the primary winding.

Similarly, the power converter 835 receives the AC voltage and outputs an AC voltage to pairs of lamps. According to one embodiment, the power converter 835 is a transformer. For example, the transformer includes a primary winding and a secondary winding. The primary winding receives the AC voltage from the power and control subsystem 815, and the secondary winding outputs the AC voltage to the lamps. For example, the secondary winding of the transformer has a much larger number of turns than the primary winding. As shown in FIG. 8, the power converters 830 and 835 are connected the two opposite ends of each lamp pairs. For example, the lamp pairs that includes the lamps 850 and 851 are connected to the two power converters at the opposite ends. In a specific embodiment, currents from the power converters 815 and 810 are different by 180 degree in phase.

As shown in FIG. 8, each of the current balancing choke is used to balance the current between two lamp pairs. Merely by of an example, the choke 861 is used to balance the lamp pair that includes lamps 850 and 851 with the lamp pair that includes lamps 852 and the 853. Similarly, the choke 864 is used to balance the lamp pair that includes lamps 850 and 851 with the lamp pair that includes lamps 856 and the 857. In the similar manner, each lamp pair is balanced with two other lamp pairs. Essentially, lamp pairs are balanced among one another. In addition, each lamp in a lamp pair is balanced against each other. Depending on the application, various types of chokes may be used. For example, each current balance choke is a common-mode choke. In another example, each current balance choke is a balun choke. In yet another example, each current balance choke includes a magnetic core and two windings. Each of these two windings are wound on the magnetic core.

Lamps in the same lamp pair are connected in series. As a result, the current of lamps in the same lamp pair is essential equal to each other in magnitude. The lamps pairs are in a parallel configuration to one another, which allows current between each lamp pair to be balanced to essentially the same level by the current balancing chokes. It is to be appreciated that the configuration as shown in system 800 allows all lamps within the system to be lit by essentially the same amount of current, thereby causing all lamps to provide luminance at substantially the same level.

The current sensing feedback component 840 provides a current sensing signal to the controller 805, which controls the power and control subsystem 810 through a gate driver. For example, the controller uses the current sensing signal to regulate the current flowing into and/or out of each of the plurality of lamps 850-857. In another example, the power and control subsystem 810 includes a PWM controller whose output pulse width is adjusted by the controller 805.

As discussed above, the system 800 is used to regulate the plurality of lamps 850-857 according to an embodiment of the present invention. For example, the plurality of lamps 850-857 includes one or more cold-cathode fluorescent lamps, and/or one or more external-electrode fluorescent lamps. In another example, the plurality of lamps 850-857 includes an even number of lamps configured in lamp pairs, thereby allow each two of the two lamps in a lamp pair to be balanced with each other.

In one embodiment, each lamp includes two terminals. For example, one of the two terminals, e.g., a high-voltage terminal, is coupled to one winding of one of the power converters, and the other of the two terminals, e.g., a low-voltage terminal, is coupled to one winding of one of the one or more current balance chokes.

As discussed above and further emphasized here, FIG. 8 is merely an example, which should not unduly limit the scope of the claims. One of ordinary skill in the art would recognize many variations, alternatives, and modifications. In one embodiment, the power and control subsystems 810 and 811 receive is controlled by the controller 805. The controller 805 receives voltage sensing signals from the current sensing feedback components 840 and 845. The current sensing signal represents the current from any single lamp selected from the plurality of lamps 850-857. In yet another embodiment, the current sensing signal represents the total current of some or all of the plurality of lamps 850-857, and the total current can be regulated by the power and control subsystems 810 and 815.

According to another embodiment, the system 800 is used to regulate a plurality of lamps 850-857 including an even number of lamps. For example, the plurality of lamps 850-857. Moreover, the one or more current balance chokes include current balance chokes 850-857. As an example, the number of current balancing choke required is equal to N/2 (or N/2−1), whereas N is the number of lamps. In one embodiment, the high-voltage terminal of lamp 850 is coupled to the power converter 830. In another embodiment, the low-voltage terminal of Lamp 850 is coupled to the current balance choke 861. As explained above, there might be other variations according to the embodiment of the present invention. For example, the configuration for the lamps and the current balancing chokes may be re-arranged.

Figure 9:
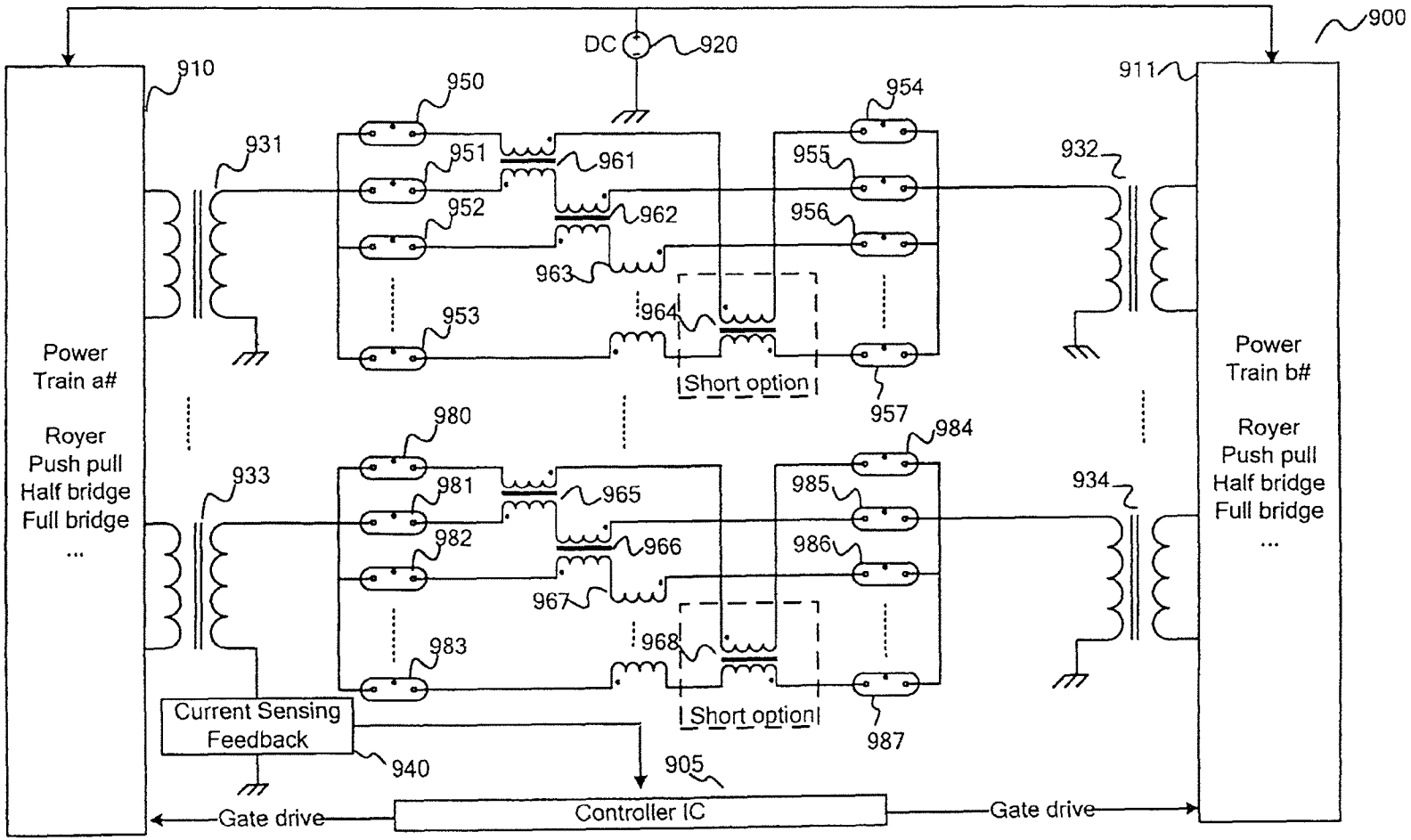
FIG. 9 is a simplified diagram illustrating a driver system according to an embodiment of the present invention.

FIG. 9 is a simplified diagram illustrating a driver system according to an embodiment of the present invention. This diagram is merely an example, which should not unduly limit the scope of the claims. One of ordinary skill in the art would recognize many variations, alternatives, and modifications.

As shown, a driver system 900 includes the following components:

1. a controller 905;
2. power and control subsystems 910 and 915;
3. power converters 931-934;
4. current balance chokes 960-968;
5. a current sensing feedback component 940;
6. a DC source 920; and
7. lamps 950-957 and 980-987.

Although the above has been shown using a selected group of components for the system 900, there can be many alternatives, modifications, and variations. For example, some of the components may be expanded and/or combined. Other components may be inserted to those noted above. Depending upon the embodiment, the arrangement of components may be interchanged with others replaced. For example, the system 900 is used to regulate a plurality of cold-cathode fluorescent lamps and/or external-electrode fluorescent lamps, such as lamps 950-957 and 980-987. Further details of these components are found throughout the present specification and more particularly below.

The power and control subsystems 910 and 915 receive a voltage from the DC source 920. For example, the voltage is a DC voltage. In another example, the voltage is approximately 5 volts. In response, the power and control subsystems 910 and 915 generates and provides an AC voltage to the power converters 930 and 935. According to a specific example, the performance and characteristics of the power and control subsystems are substantially matched.

According to an embodiment, the power and control subsystems 910 and 915 also receives certain control signals. For example, the control signals include an enabling (ENA) signal and a dimming (DIM) signal. In response, the power and control subsystems 910 and 915 generate one or more gate drive signals. Additionally, the power and control subsystems 910 and 915 includes one or more MOSFET transistors. These MOSFET transistors convert the DC voltage to AC voltage in response to the one or more gate drive signals. According to another embodiment, the DC source 920 can use various types of configurations, such as Royer, push-pull, half-bridge, and/or full bridge.

The power converter 931 receives the AC voltage and outputs an AC voltage to pairs of lamps. According to one embodiment, the power converter 931 is a transformer. For example, the transformer includes a primary winding and a secondary winding. The primary winding receives the AC voltage from the power and control subsystem 931, and the secondary winding outputs the AC voltage to the lamps. For example, the secondary winding of the transformer has a much larger number of turns than the primary winding.

Similarly, the other power converters (e.g., power converters 932-934) are connected receive an AC voltage and output a different AV voltage to the lamps. Depending on the application, the system 900 may have a higher number of power converters for providing power to the lamps.

As shown in FIG. 9, each of the current balancing choke is used to balance the current between two lamp pairs. Merely by of an example, the choke 961 is used to balance the lamp pair that includes lamps 950 and 954 with the lamp pair that includes lamps 951 and the 955. Similarly, the choke 964 is used to balance the lamp pair that includes lamps 950 and 954 with the lamp pair that includes lamps 953 and the 957. In the similar manner, each lamp pair is balanced with two other lamp pairs. Essentially, lamp pairs are balanced among one another. In addition, each lamp in a lamp pair is balanced against each other. Depending on the application, various types of chokes may be used. For example, each current balance choke is a common-mode choke. In another example, each current balance choke is a balun choke. In yet another example, each current balance choke includes a magnetic core and two windings. Each of these two windings are wound on the magnetic core.

Lamps in the same lamp pair are connected in series. As a result, the current of lamps in the same lamp pair is essential equal to each other in magnitude. The lamps pairs are in a parallel configuration to one another, which allows current between each lamp pair to be balanced to essentially the same level by the current balancing chokes. It is to be appreciated that the configuration as shown in system 900 allows all lamps within the system to be lit by essentially the same amount of current, thereby causing all lamps to provide luminance at substantially the same level.

As shown in FIG. 9, four lamps pairs are grouped together to share two power converters and four current balancing chokes. It is to be appreciated such configuration is easily scalable, as the number of lamps pairs can be increased by adding groups of lamp pairs.

The current sensing feedback component 940 provides a current sensing signal to the controller 905, which controls the power and control subsystem 810 through a gate driver. For example, the controller uses the current sensing signal to regulate the current flowing into and/or out of each of the plurality of lamps. In another example, the power and control subsystem 910 includes a PWM controller whose output pulse width is adjusted by the controller 905.

As discussed above, the system 900 is used to regulate the plurality of lamps according to an embodiment of the present invention. For example, the plurality of lamps includes one or more cold-cathode fluorescent lamps, and/or one or more external-electrode fluorescent lamps. In another example, the plurality of lamps includes an even number of lamps configured in lamp pairs, thereby allow each two of the two lamps in a lamp pair to be balanced with each other.

In one embodiment, each lamp includes two terminals. For example, one of the two terminals, e.g., a high-voltage terminal, is coupled to one winding of one of the power converters, and the other of the two terminals, e.g., a low-voltage terminal, is coupled to one winding of one of the one or more current balance chokes.

As discussed above and further emphasized here, FIG. 9 is merely an example, which should not unduly limit the scope of the claims. One of ordinary skill in the art would recognize many variations, alternatives, and modifications. In one embodiment, the power and control subsystems 910 and 911 receive is controlled by the controller 905. The controller 905 receives voltage sensing signals from the current sensing feedback component 940. The current sensing signal represents the current from any single lamp selected from the plurality of lamps. In yet another embodiment, the current sensing signal represents the total current of some or all of the plurality of lamps, and the total current can be regulated by the power and control subsystems 910 and 915.

According to another embodiment, the system 900 is used to regulate a plurality of lamps including an even number of lamps. For example, the plurality of lamps. Moreover, the one or more current balance chokes include current balance chokes. As an example, the number of current balancing choke required is equal to N/2 (or N/2−1), whereas N is the number of lamps. In one embodiment, the high-voltage terminal of lamp 850 is coupled to the power converter 931. In another embodiment, the low-voltage terminal of Lamp 950 is coupled to the current balance choke 961. As explained above, there might be other variations according to the embodiment of the present invention. For example, the configuration for the lamps and the current balancing chokes may be re-arranged.

Figure 10:
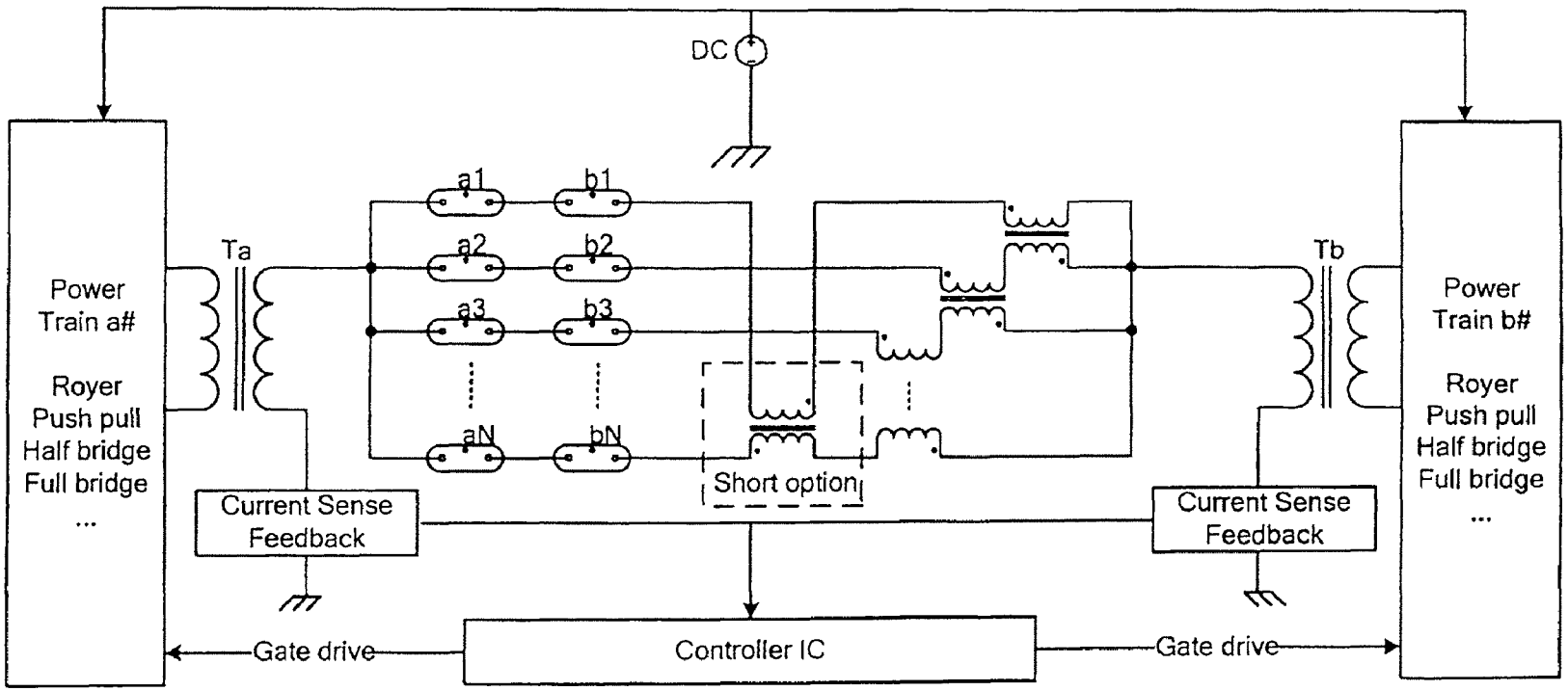
FIG. 10 is a simplified diagram illustrating a driver system according to an embodiment of the present invention.

FIG. 10 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter.

Figure 11:
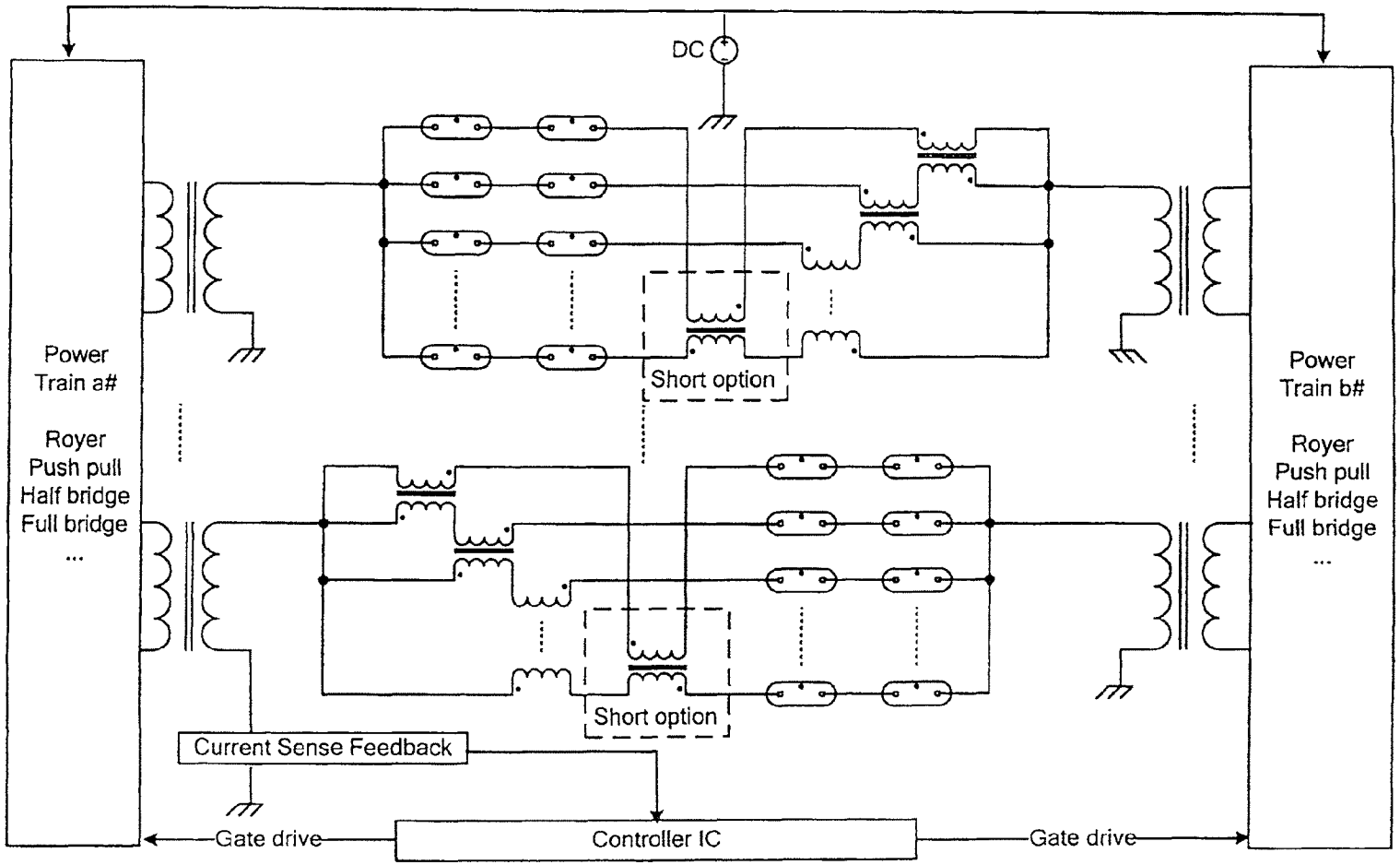
FIG. 11 is a simplified diagram illustrating a driver system according to an embodiment of the present invention.

FIG. 11 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 11 is easily scalable.

Figure 12:
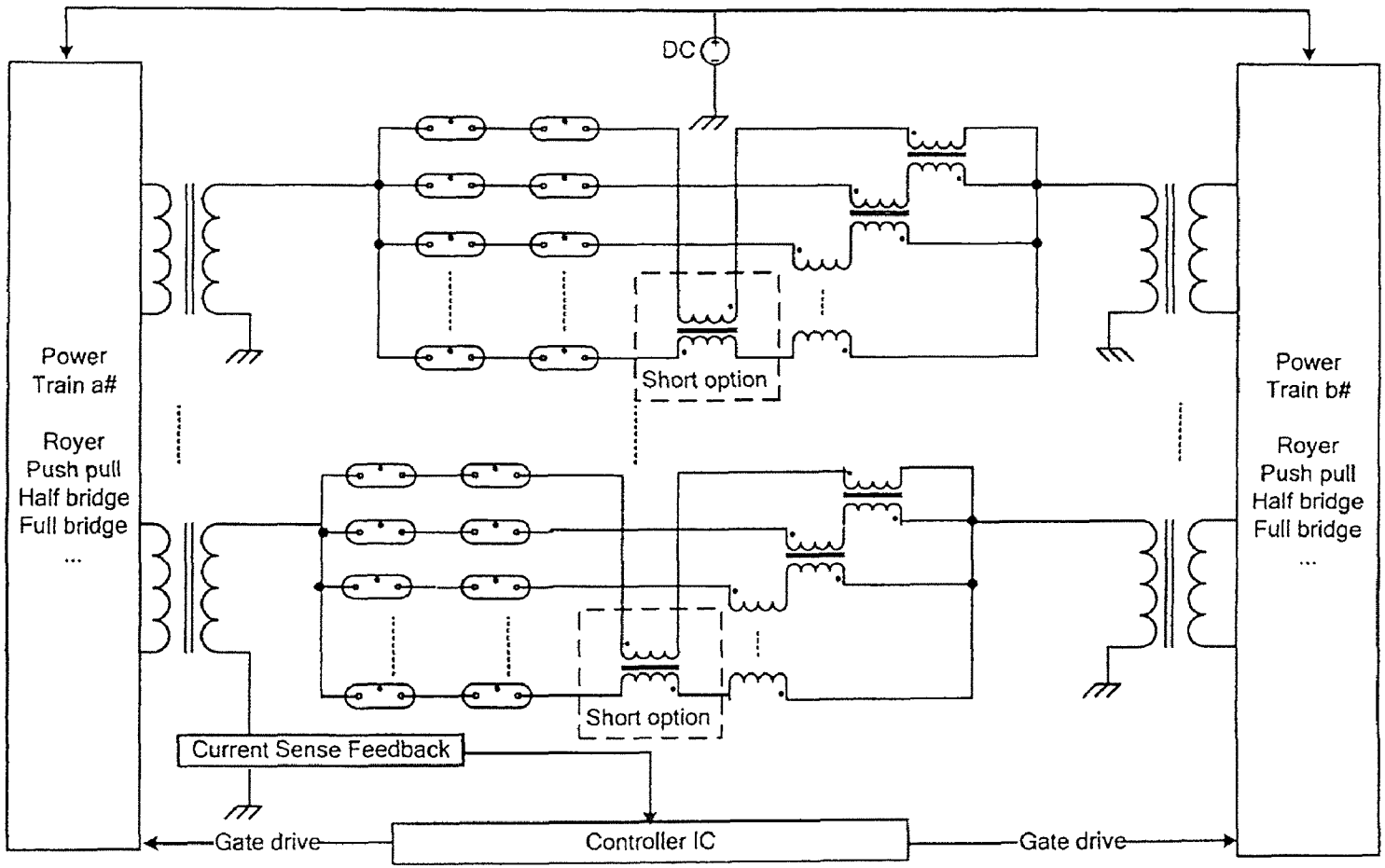
FIG. 12 is a simplified diagram illustrating a driver system according to an embodiment of the present invention.

FIG. 12 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 12 is easily scalable.

Figure 13:
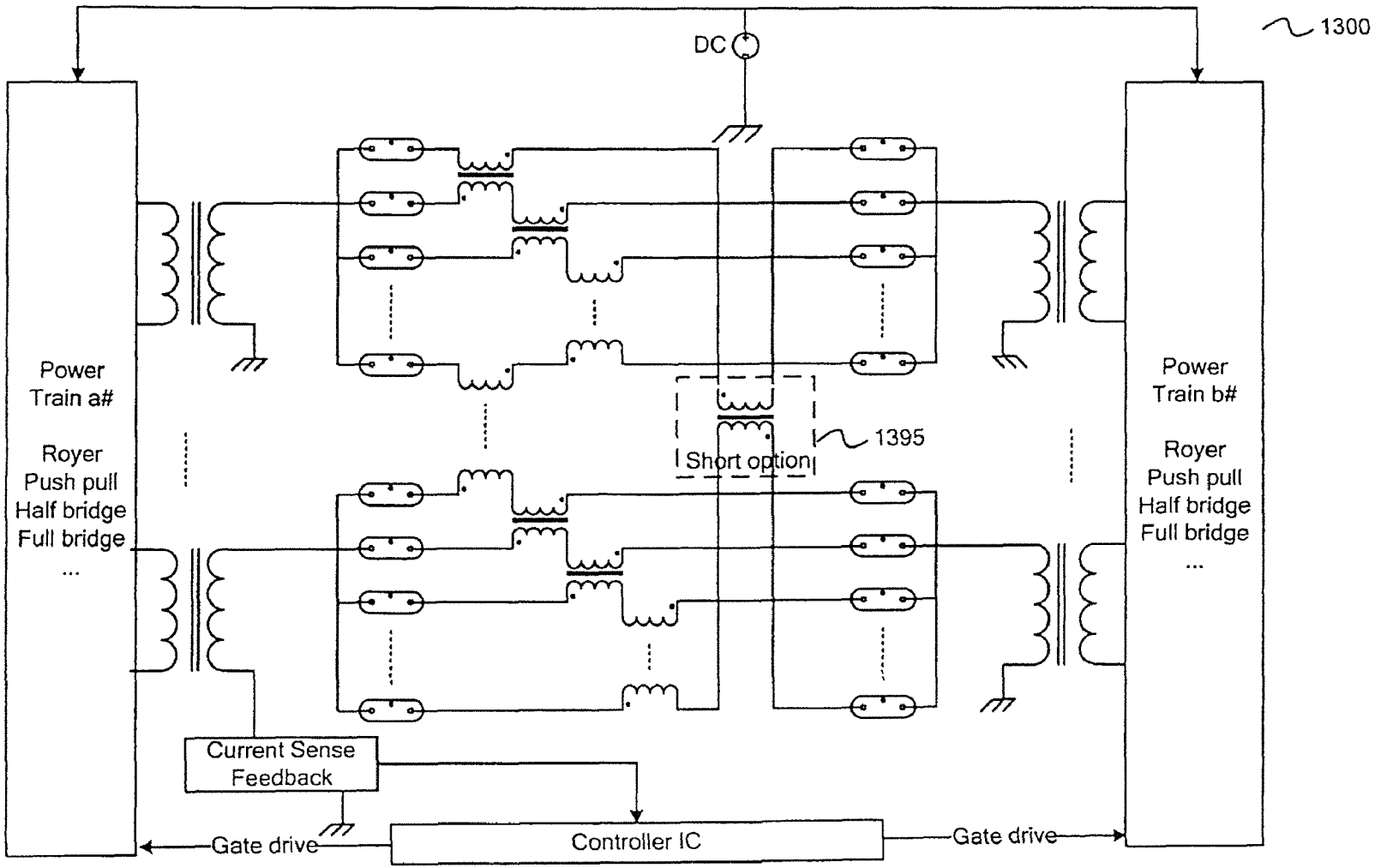
FIG. 13 is a simplified diagram illustrating a driver system according to an embodiment of the present invention.

FIG. 13 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 13 is easily scalable. In contrast to the system illustrated in FIG. 12, lamps pairs are not grouped, which allows lamp pairs in the system to be balanced against one another.

Figure 14:
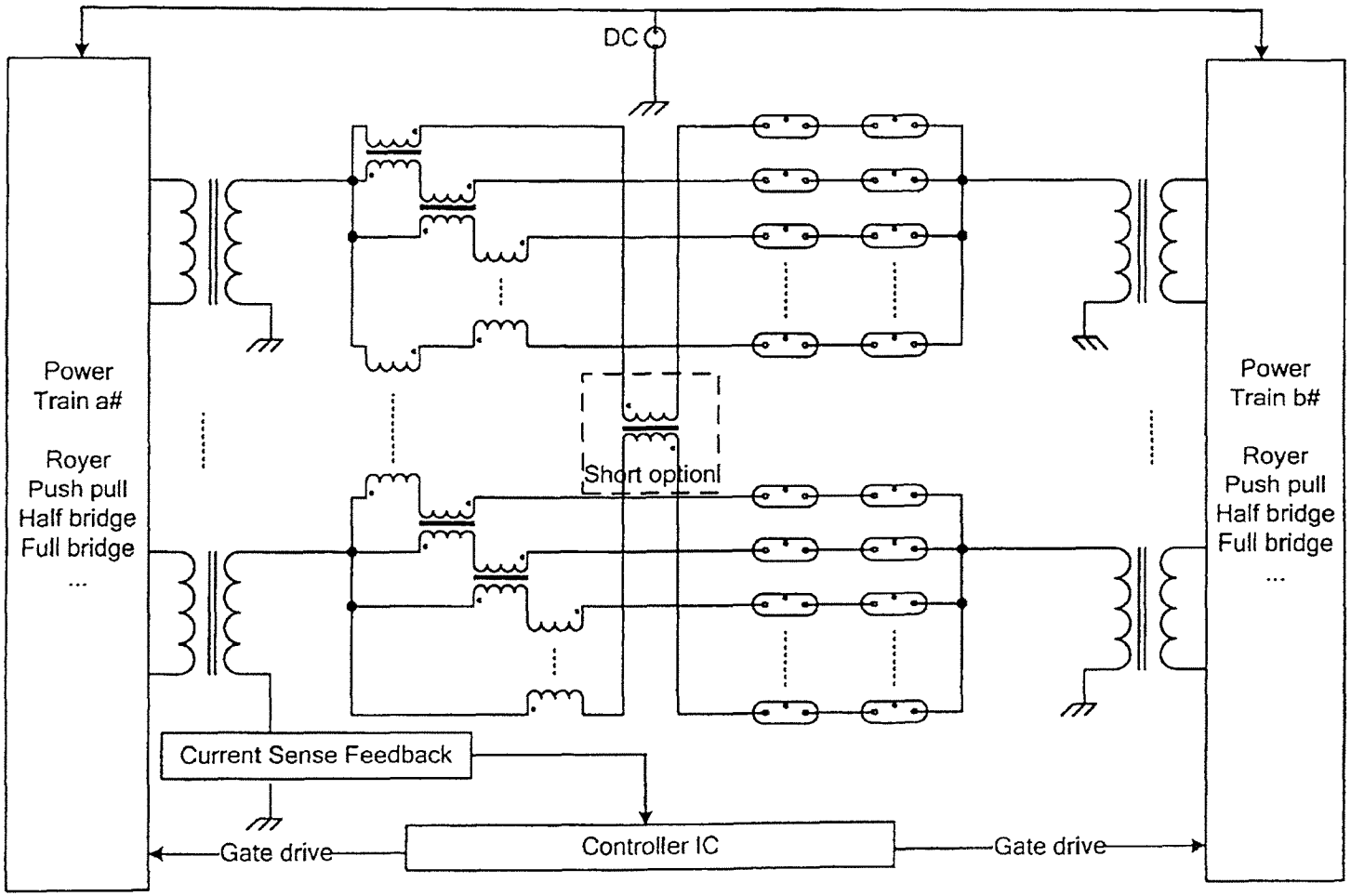
FIG. 14 is a simplified diagram illustrating a driver system according to an embodiment of the present invention.

FIG. 14 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 14 is easily scalable.

Figure 15:
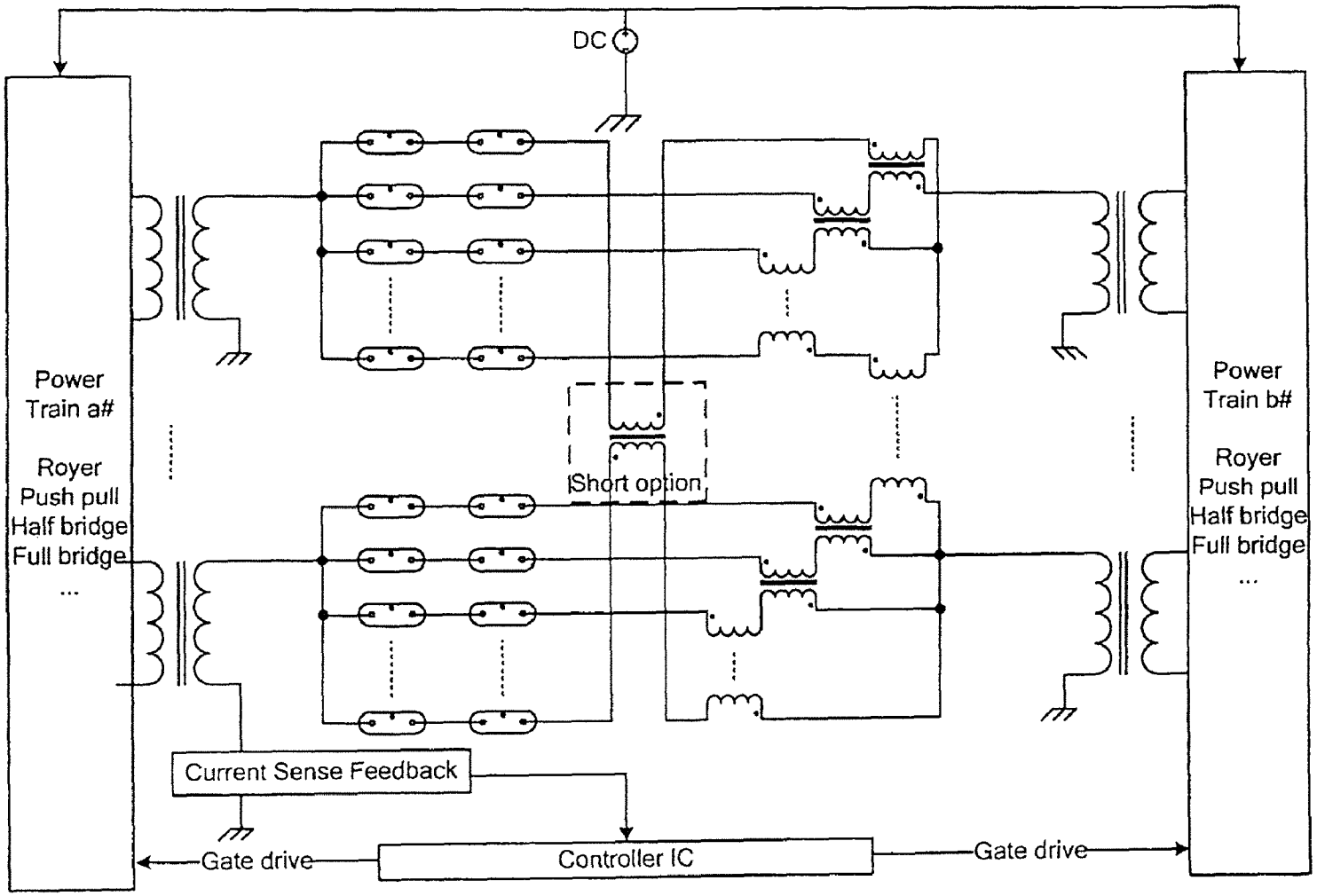
FIG. 15 is a simplified diagram illustrating a driver system according to an embodiment of the present invention.

FIG. 15 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 15 is easily scalable. In contrast to the system illustrated in FIG. 12, lamps pairs are not grouped, which allows lamp pairs in the system to be balanced against one another.

Figure 16:
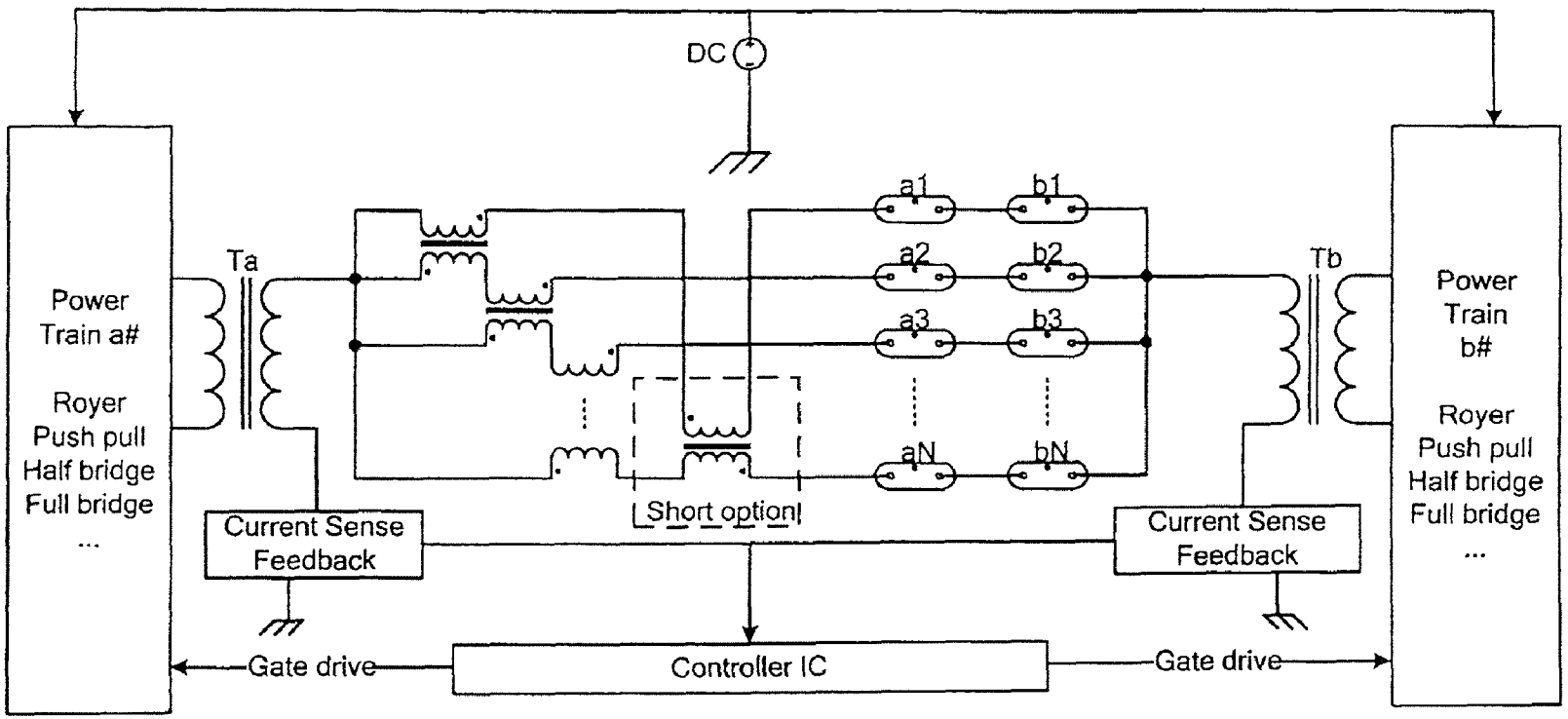
FIG. 16 is a simplified diagram illustrating a driver system according to an embodiment of the present invention.

FIG. 16 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter.

Figure 17:
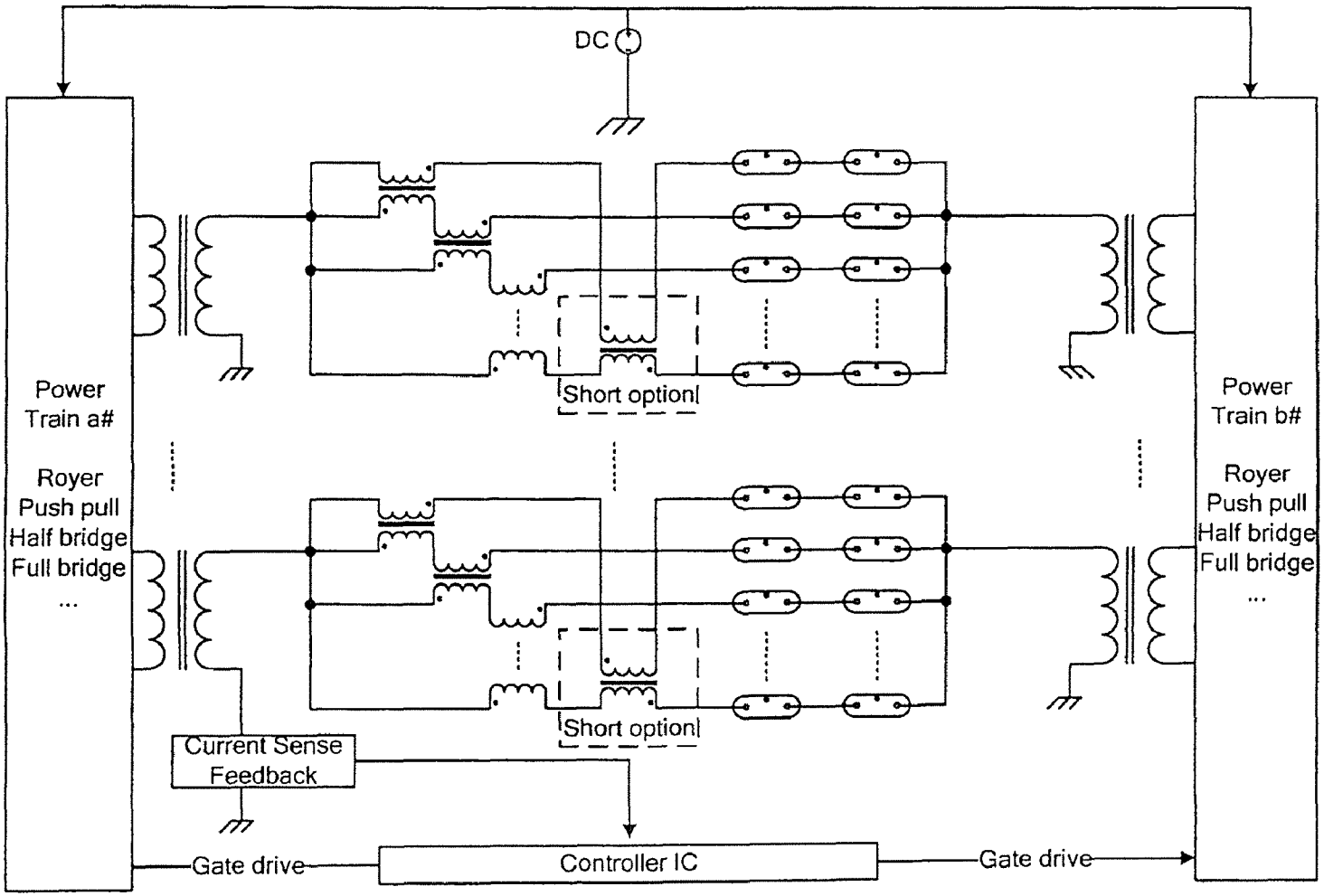
FIG. 17 is a simplified diagram illustrating a driver system according to an embodiment of the present invention.

FIG. 17 is a simplified diagram illustrating a driver system according to an embodiment of the present invention. This diagram is merely an example, which should not unduly limit the scope of the claims. One of ordinary skill in the art would recognize many variations, alternatives, and modifications. As shown, lamps in each of lamp pair are directed coupled to each other, where as current balancing chokes are coupled to one of the lamps and a power converter. It is to be appreciated that the system as shown in FIG. 17 is easily scalable. In contrast to the system illustrated in FIG. 12, lamps pairs are not grouped, which allows lamp pairs in the system to be balanced against one another.

Figure 18:
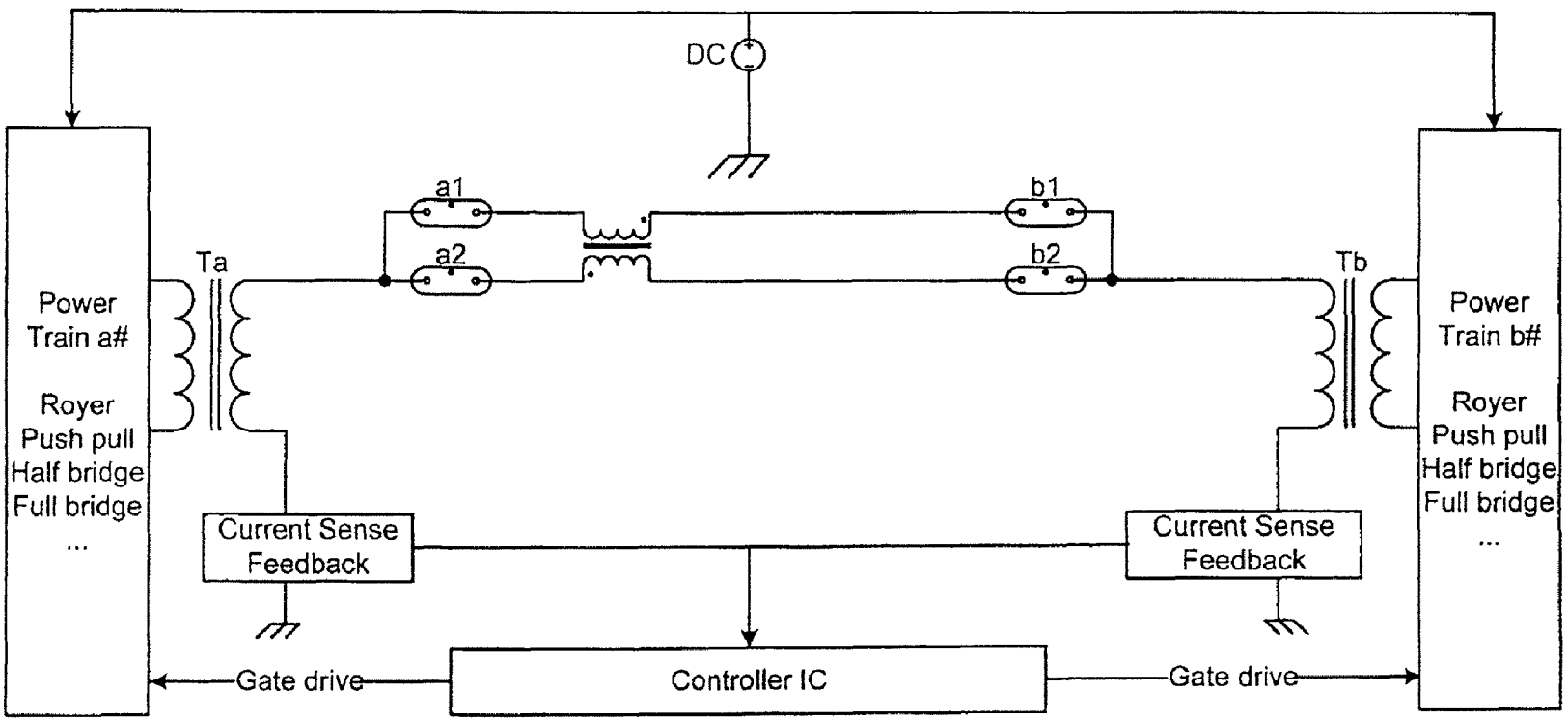
FIG. 18 is a simplified diagram illustrating a driver system according to an embodiment of the present invention.

FIG. 18 is a simplified diagram illustrating a driver system according to an embodiment of the present invention. This diagram is merely an example, which should not unduly limit the scope of the claims. One of ordinary skill in the art would recognize many variations, alternatives, and modifications. As shown, two lamp pairs are coupled in series with each other through a current balancing chokes. Each of the lamp pairs has two lamps in parallel and coupled to the coke. It is to be appreciated that the configuration according to FIG. 18 is cost-effective, as only one current balancing choke is needed for four lamps.

Figure 19:
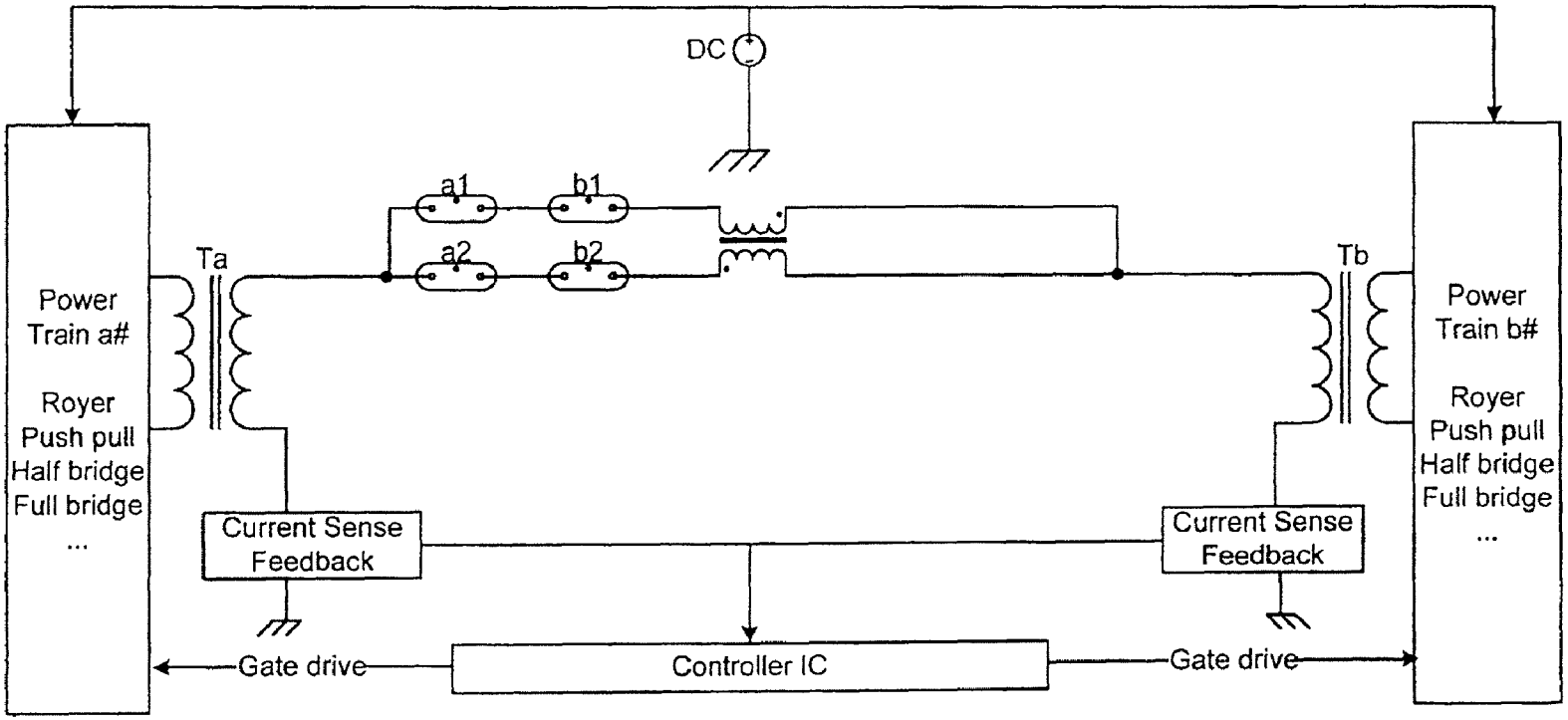
FIG. 19 is a simplified diagram illustrating a driver system according to an embodiment of the present invention.

FIG. 19 is a simplified diagram illustrating a driver system according to an embodiment of the present invention. This diagram is merely an example, which should not unduly limit the scope of the claims. One of ordinary skill in the art would recognize many variations, alternatives, and modifications. As shown, two lamp pairs are coupled in parallel with each other through a current balancing chokes. Each of the lamp pairs has two lamps in series and coupled to the coke. It is to be appreciated that the configuration according to FIG. 19 is cost-effective, as only one current balancing choke is needed for four lamps.

Figure 20:
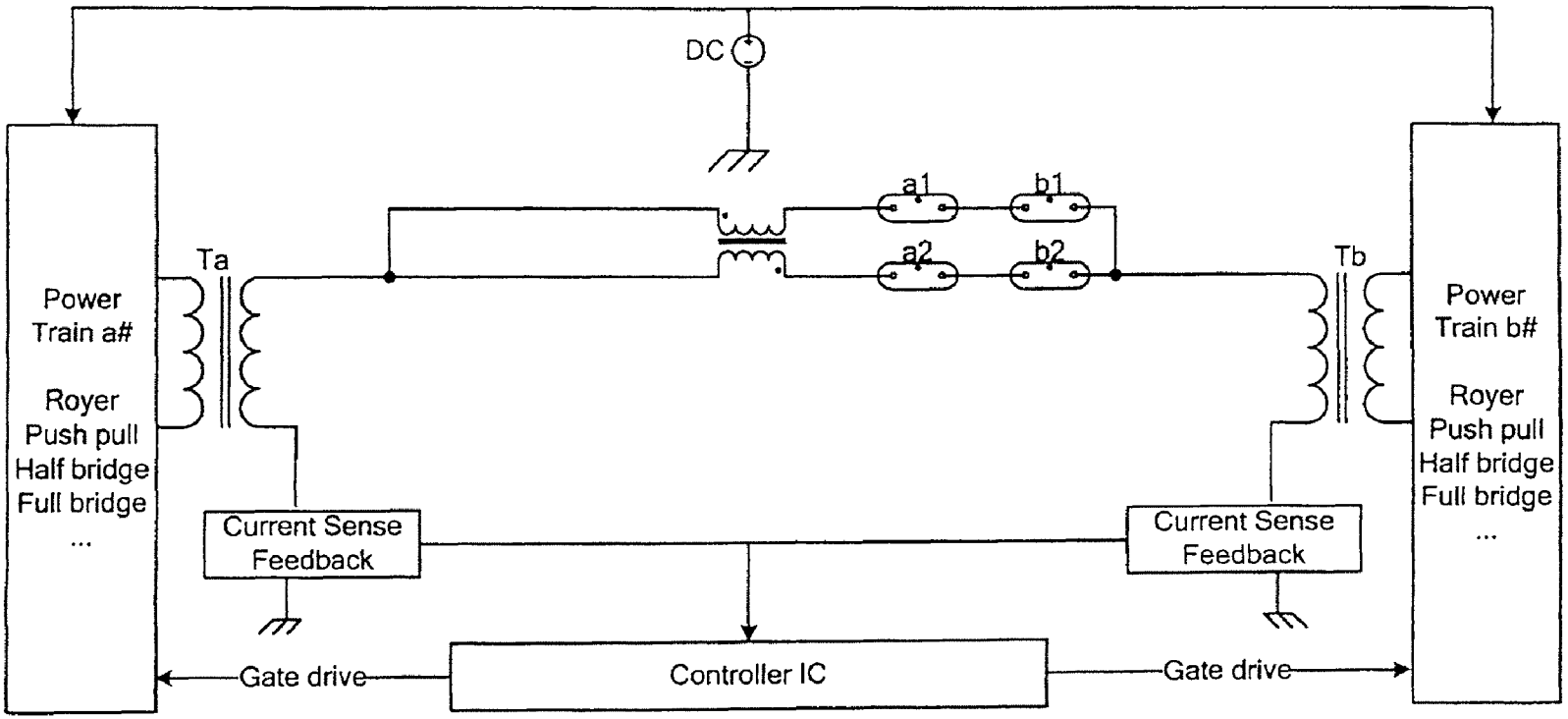
FIG. 20 is a simplified diagram illustrating a driver system according to an embodiment of the present invention.

FIG. 20 is a simplified diagram illustrating a driver system according to an embodiment of the present invention. This diagram is merely an example, which should not unduly limit the scope of the claims. One of ordinary skill in the art would recognize many variations, alternatives, and modifications. As shown, two lamp pairs are coupled in parallel with each other through a current balancing chokes. Each of the lamp pairs has two lamps in series and coupled to the coke. It is to be appreciated that the configuration according to FIG. 20 is cost-effective, as only one current balancing choke is needed for four lamps.

Figure 21:
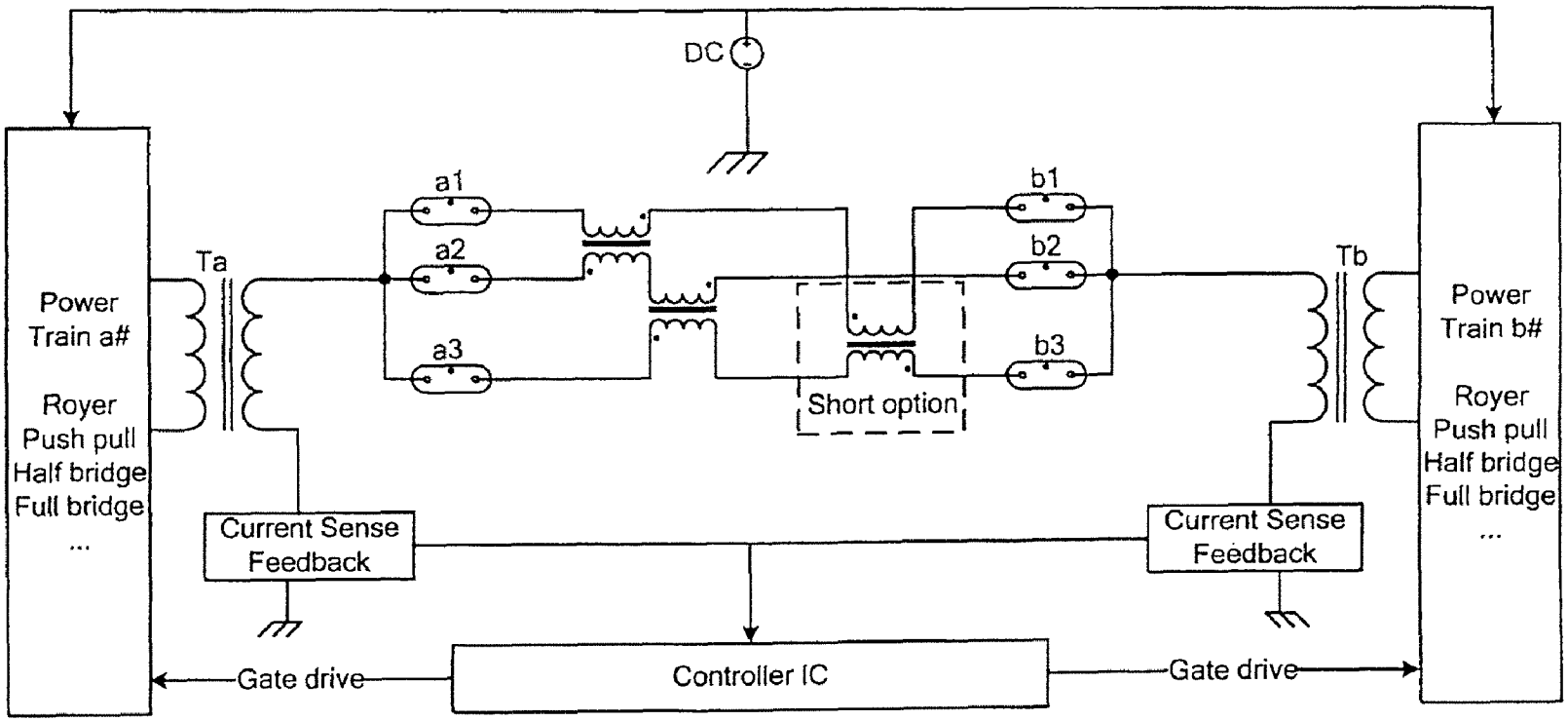
FIG. 21 is a simplified diagram illustrating a driver system according to an embodiment of the present invention.

FIG. 21 is a simplified diagram illustrating a driver system according to an embodiment of the present invention. This diagram is merely an example, which should not unduly limit the scope of the claims. One of ordinary skill in the art would recognize many variations, alternatives, and modifications. As shown, a total of six lamps are balanced by two or three chokes. For example, the six lamps can be viewed as three pairs, each of the pairs having two lamps in series with a choke. Depending on the application, two-choke or three-choke configurations may be used. It is to be appreciated even with two-choke configuration, current is balanced among each lamps, thereby provide current balancing in a cost-effective manner (e.g., two chokes for six lamps).

Figure 22:
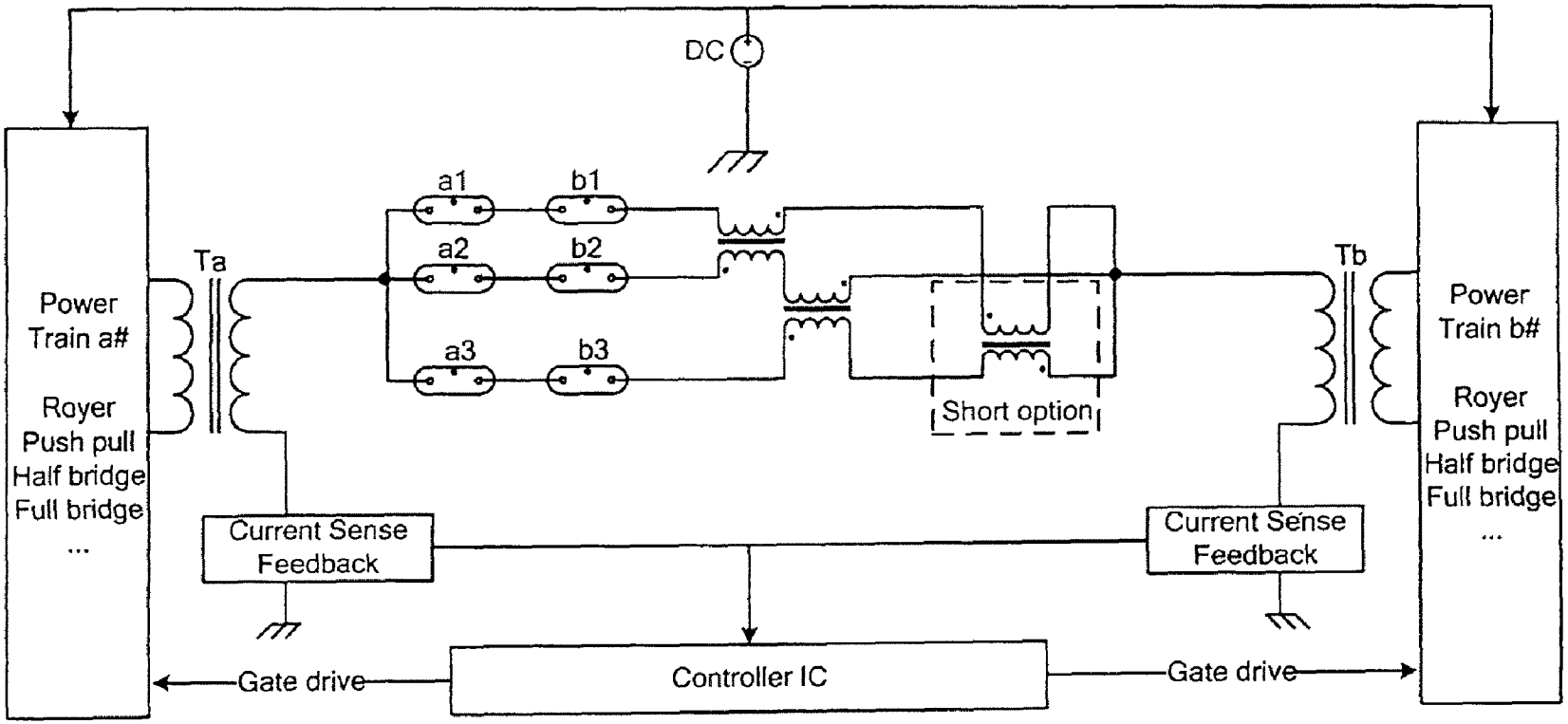
FIG. 22 is a simplified diagram illustrating a driver system according to an embodiment of the present invention.

FIG. 22 is a simplified diagram illustrating a driver system according to an embodiment of the present invention. This diagram is merely an example, which should not unduly limit the scope of the claims. One of ordinary skill in the art would recognize many variations, alternatives, and modifications. As shown, a total of six lamps are balanced by two or three chokes. For example, the six lamps can be viewed as three pairs, each of the pairs having two lamps in series with a choke. Depending on the application, two-choke or three-choke configurations may be used. It is to be appreciated even with two-choke configuration, current is balanced among each lamps, thereby provide current balancing in a cost-effective manner (e.g., two chokes for six lamps).

Figure 23:
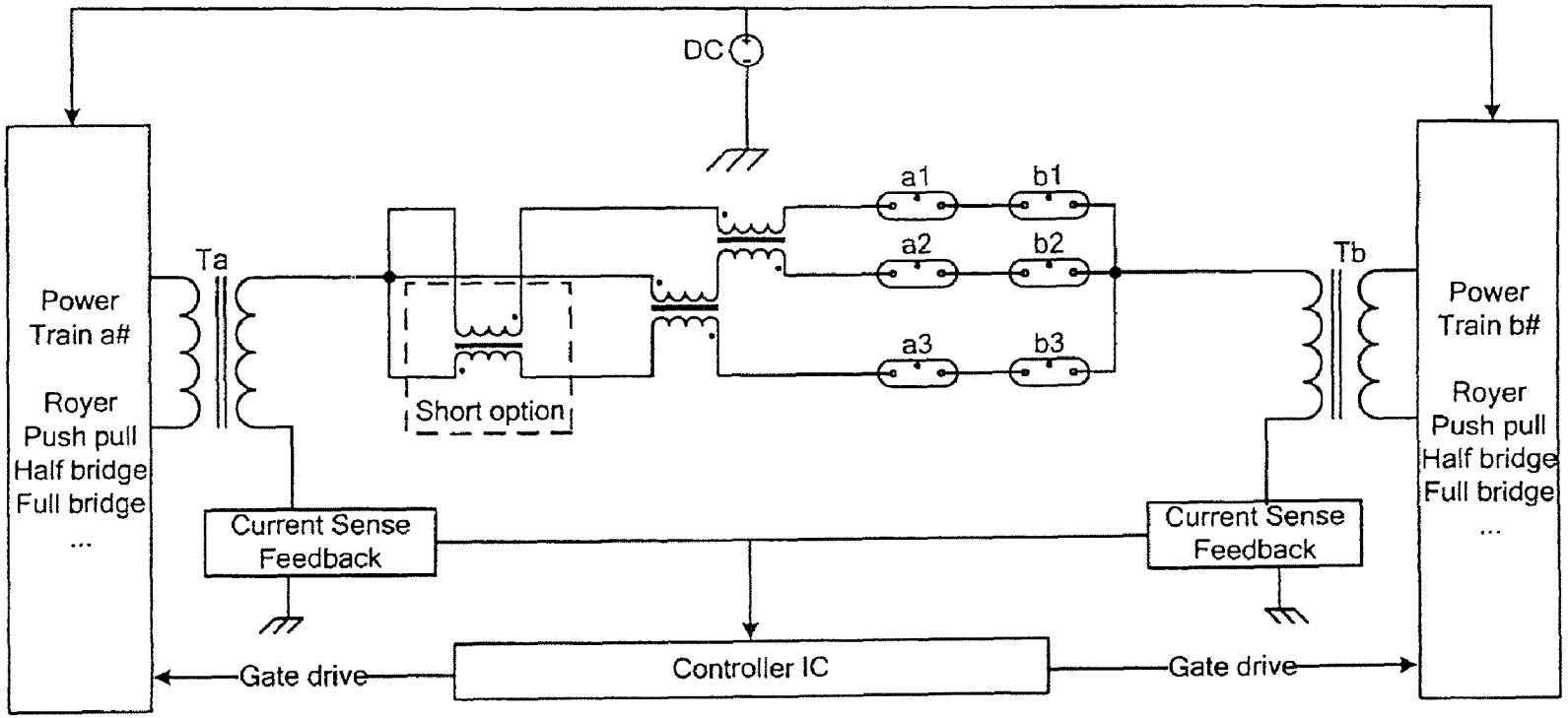
FIG. 23 is a simplified diagram illustrating a driver system according to an embodiment of the present invention.

FIG. 23 is a simplified diagram illustrating a driver system according to an embodiment of the present invention. This diagram is merely an example, which should not unduly limit the scope of the claims. One of ordinary skill in the art would recognize many variations, alternatives, and modifications. As shown, a total of six lamps are balanced by two or three chokes. For example, the six lamps can be viewed as three pairs, each of the pairs having two lamps in series with a choke. Depending on the application, two-choke or three-choke configurations may be used. It is to be appreciated even with two-choke configuration, current is balanced among each lamps, thereby provide current balancing in a cost-effective manner (e.g., two chokes for six lamps).

According to an embodiment, the present invention provides a system for driving a plurality of cold-cathode fluorescent lamps. The system includes a subsystem configured to receive at least a DC voltage and generate a first AC voltage in response to at least the DC voltage. The system also includes a power converter configured to receive the first AC voltage and convert the first AC voltage to at least a second AC voltage. The system further includes a plurality of current balancing devices. Each of the plurality of current balancing devices is configured to receive two currents and balance the two currents. The plurality of current balancing devices includes at least a first current balancing device, a second current balancing device. In addition, the system includes a plurality of lamp pairs. The plurality of cold-cathode fluorescent lamp pairs includes at least a first pair and a second pair. The first pair, the second pair, and the third pair are in parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current. For example, the embodiment is illustrated according to FIG. 9.

According to another embodiment, the present invention provides a system for driving a plurality of cold-cathode fluorescent lamps. The system includes a first power converter configured to receive the first AC voltage and convert the first AC voltage to at least a second AC voltage. In addition, the system includes a second power converter configured to receive the a third AC voltage and convert the third AC voltage to at least a fourth AC voltage. The system further includes a current sensing component electrically coupled to the first power converter, the current sensor being configured to provide a signal. The system also includes a controller being configured to receive the signal. Furthermore, the system includes a plurality of current balancing devices, each of the plurality of current balancing devices being configured to receive two currents and balance the two currents. The plurality of current balancing devices includes at least a first current balancing device, a second current balancing device. The system also includes a plurality of lamp pairs. The plurality of lamp pairs including at least a first pair, a second pair. The first pair, the second pair, and the third pair are in a parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current. For example, the embodiment is illustrated according to FIG. 9.

According to yet another embodiment, the present invention provides a system for driving a plurality of cold-cathode fluorescent lamps. The system includes a first power converter configured to receive the a first AC voltage and convert the first AC voltage to at least a second AC voltage. The system additionally includes a second power converter configured to receive the a third AC voltage and convert the third AC voltage to at least a fourth AC voltage. The system also includes a first current sensing component electrically coupled to the first power converter. The first current sensor is configured to provide a first feedback signal. The system additionally includes a second current sensing component electrically coupled to the second power converter, the second current sensing component being configured to provide a second feedback signal. In addition, the system includes a plurality of current balancing devices, each of the plurality of current balancing devices being configured to receive two currents and balance the two currents. The plurality of current balancing devices includes at least a first current balancing device, a second current balancing device. Furthermore, the system includes a plurality of lamp pairs which includes at least a first pair, a second pair. The first pair, the second pair, and the third pair are in parallel configurations. The first pair is associated with a first current. The second pair is associated with a second current. The third pair is associated with a third current. The first current balancing device is configured to balance the first current and the second current. The second current balancing device is configured to balance the first current and the third current. The third current balancing device is configured to balance the third current and the second current. For example, the embodiment is illustrated according to FIG. 8.

According to yet another embodiment, the present invention provides a system for driving a plurality of cold-cathode fluorescent lamps. The system includes a first power converter configured to receive a first AC voltage and convert the first AC voltage to at least a second AC voltage. The system also includes a second power converter configured to receive a third AC voltage and convert the third AC voltage to at least a fourth AC voltage. The system also includes a third power converter configured to receive a first AC voltage and convert the first AC voltage to at least a fifth AC voltage. The system additionally includes a fourth power converter configured to receive a third AC voltage and convert the first AC voltage to at least a second AC voltage. The system also includes a plurality of current balancing devices, each of the plurality of current balancing devices being configured to receive two currents and balance the two currents. The plurality of current balancing devices includes at least a first current balancing device, a second current balancing device, and a third current balancing device. The system also includes a plurality of lamp pairs, the plurality of lamp pairs including at least a first pair, a second pair, a third pair, and a fourth pair. The first pair and the second pair are coupled to the first and the second power converters, the first pair and the second pair being in a parallel configuration. The third pair and the fourth pair are coupled to the third and the fourth power converters, the third pair and the fourth pair being in a parallel configuration. The first current balancing device is configured to balance the first pair and the second pair. The second current balancing device is configured to balance the third and the fourth pairs. For example, the embodiment is illustrated according to FIG. 10.

Many benefits are achieved by way of the present invention over conventional techniques. For example, some embodiments of the present invention provide a driver system that can balance currents between or among any number of lamps. Certain embodiments of the present invention provide a configuration in which only one or two inductive windings are in series with each lamp between the secondary winding of the transformer and the ground voltage. For example, the one or two inductive windings belong to one or two current balance chokes respectively. In another example, the currents flowing through at least majority of the lamps go through same types of circuit components. Some embodiments of the present invention provide great flexibility to the design and manufacturing of multi-lamp driver system. Certain embodiments of the present invention can improve stability and reliability of a multi-lamp driver system. Some embodiments of the present invention can simplify processes and lower costs for making a multi-lamp driver system. Certain embodiments of the present invention can balance both the currents flowing into some lamps and the currents flowing out of certain lamps. Some embodiments of the present invention can improve current balancing of a multi-lamp driver system by eliminating or reducing adverse effects by stray conductance or parasitic capacitance of the lamps. Certain embodiments of the present invention can provide current balancing to lamps driven by different transformers using cyclic current balance schemes. Some embodiments of the present invention can improve brightness uniformity on an LCD screen lit by a plurality of lamps that are driven by one or more transformers. According to a specific embodiment, the present invention provides a cost effective solution to balancing currents. For example, for N number lamps, only N/2 (or N/2−1) number of current balancing chokes is needed. Depending upon the embodiment, one or more of these benefits may be achieved. These and other benefits will be described in more detail throughout the present specification and more particularly below.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for driving loads, the system comprising:

a first power generator configured to generate a plurality of AC voltages including at least a first AC voltage and a second AC voltage; and a plurality of current balancing devices, each of the plurality of current balancing devices being configured to receive two currents and balance the two currents;

wherein:

each of a plurality of loads is configured to be directly or indirectly coupled between two of the plurality of AC voltages;

the plurality of loads corresponds to one or more groups including groups 1 through m, $m \geqq 2$;

each group i of the plurality of groups, $1 \leqq i \leqq m$, includes:

a plurality of $n_i$ loads including loads L(1,i) through $L(n_i,i)$, each of the plurality of $n_i$ loads being associated with a load current I(1,i) through $I(n_i,i)$ respectively, $n_i \geqq 3$; and current balancing devices CBD(1,i) through CBD $(n_i-1,i)$ selected from the plurality of current balancing devices, each current balancing device CBD (j,i) of CBD(1,i) through $CBD(n_i-1,i)$ is configured to balance load currents I(j,i) and I(j+1,i), respectively, $1 \leqq j \leqq n_i-1$; and the plurality of current balancing devices further includes, for each group i, an additional current balancing device for balancing load currents I(1,i) and $I(n_i,i)$.

2. The system of claim 1 wherein each of the plurality of loads comprises at least one cold-cathode fluorescent lamp.

3. The system of claim 1 wherein each of the plurality of loads comprises at least one external-electrode fluorescent lamp.

4. The system of claim 1 wherein each of the plurality of loads comprises at least two lamps including a first lamp and a second lamp.

5. The system of claim 4 wherein the first lamp and the second lamp are directly or indirectly coupled in series.

6. The system of claim 5 wherein each of the plurality of current balancing devices is directly or indirectly coupled between the first lamp and the second lamp, respectively.

7. The system of claim 1 wherein each of the plurality of current balancing devices is directly or indirectly coupled between the first power generator and respective loads associated with the two currents balanced by the current balancing device.

8. The system of claim 1, and further comprising a sensor configured to sense at least one load current and generate a current sensing signal.

9. The system of claim 8 wherein the first power generator is further configured to regulate the first AC voltage based on information associated with the current sensing signal.

10. The system of claim 9 wherein the first power generator is further configured to use pulse-width modulation to regulate the first AC voltage based on information associated with the current sensing signal.

11. The system of claim 1 wherein each of the plurality of current balancing devices is a current balance choke.

12. The system of claim 11 wherein the current balance choke is a common-mode choke.

13. The system of claim 11 wherein the current balance choke is a balun choke.

14. The system of claim 1 wherein the first power generator comprises a second power generator and a third power generator.

15. The system of claim 14 wherein the second power generator is configured to generate the first AC voltage and the third power generator is configured to generate the second AC voltage.

16. The system of claim 1 wherein the first power generator further comprises:

a subsystem configured to receive at least a DC voltage and generate a third AC voltage in response to at least the DC voltage; and a power converter configured to receive the third AC voltage and convert the third AC voltage to at least the first AC voltage.

17. The system of claim 16, and further comprising a sensor configured to sense at least one load current and generate a current sensing signal.

18. The system of claim 17 wherein the first power generator is further configured to regulate the third AC voltage based on information associated with the current sensing signal.

19. The system of claim 18 wherein the first power generator is further configured to use pulse-width modulation to regulate the third AC voltage based on information associated with the current sensing signal.

20. The system of claim 16 wherein the power converter includes a first transformer, the first transformer being configured to output the first AC voltage.

21. The system of claim 20 wherein the power converter further includes a second transformer, the second transformer being configured to output the second AC voltage.

22. The system of claim 1 wherein the first AC voltage is 180 degrees out of phase with the second AC voltage.

23. A method for driving loads, the method comprising:

generating a plurality of AC voltages including at least a first AC voltage and a second AC voltage;

driving one or more groups including groups 1 through m, $m \geqq 2$, with at least two AC voltages from the plurality of AC voltages; and balancing a plurality of load currents by a plurality of current balancing devices, each of the plurality of current balancing devices being configured to receive two currents and balance the two currents;

wherein each group i of the one or more groups, $1 \leqq i \leqq m$, includes a plurality of $n_i$ loads including loads L(1,i) through $L(n_i,i)$, each of the plurality of loads being associated with a load current I(1,i) through $I(n_i,i)$ respectively, $n_i \geqq 3$;

wherein the process of balancing a plurality of load currents includes:

balancing each pair of load currents I(j,i) and I(j+1,i), $1 \leqq j \leqq n_i-1$, by each current balancing device CBD(j, i) from CBD(1,i) through $CBD(n_i-1,i)$, respectively; and for each group i, balancing the load currents I(1,i) and $I(n_i,i)$ by each current balancing device $CBD(n_i,i)$ respectively.

24. The method of claim 23 wherein each of the loads L(1,i) through $L(n_i,i)$ comprises at least one cold-cathode fluorescent lamp.

25. The method of claim 23 wherein each of the loads L(1,i) through $L(n_i,i)$ comprises at least one external-electrode fluorescent lamp.

26. The method of claim 23 wherein each of the loads L(1,i) through $L(n_i,i)$ comprises at least two lamps including a first lamp and a second lamp.

* * * * *